US006908373B1

(12) United States Patent
Ohman et al.

(10) Patent No.: US 6,908,373 B1
(45) Date of Patent: Jun. 21, 2005

(54) SHEAR BLADE SHARPENER METHOD AND APPARATUS

(76) Inventors: Larry S. Ohman, 750-B Mullet Dr., Cape Canaveral, FL (US) 32920; Francis R. Davis, 849 Hamilton Ave., Rockledge, FL (US) 32955

( * ) Notice: Subject to any disclaimer, the term of this patent is extended or adjusted under 35 U.S.C. 154(b) by 26 days.

(21) Appl. No.: 10/436,189

(22) Filed: May 12, 2003

Related U.S. Application Data

(63) Continuation-in-part of application No. 10/304,201, filed on Nov. 26, 2002.

(51) Int. Cl.[7] ..... B24B 3/36
(52) U.S. Cl. ..... 451/278; 451/160
(58) Field of Search ..... 451/160, 158, 451/45, 48, 278, 293

(56) References Cited

U.S. PATENT DOCUMENTS

| | | | | |
|---|---|---|---|---|
| 1,199,672 A | * | 9/1916 | Dick | 451/159 |
| 2,069,097 A | * | 1/1937 | Root | 451/449 |
| 2,539,107 A | * | 1/1951 | Sectish | 451/160 |
| 3,834,319 A | | 9/1974 | Kastenbein | 104/246 |
| 3,917,350 A | | 11/1975 | Bricher | 299/24 |
| 4,069,620 A | | 1/1978 | Sakcriska | 51/100 |
| 4,235,050 A | | 11/1980 | Hannaford et al. | 51/34 |
| 4,241,544 A | | 12/1980 | Hampton | 51/33 |
| 4,294,043 A | | 10/1981 | Sakcriska | 51/100 |
| 4,392,332 A | | 7/1983 | Sakcriska | 51/92 |
| 4,532,735 A | * | 8/1985 | Dahlgren et al. | 451/160 |
| 4,705,320 A | | 11/1987 | Zamboni | 299/24 |
| 5,127,194 A | | 7/1992 | Jobin | 51/5 |
| 5,233,792 A | * | 8/1993 | Suzuki | 451/160 |
| 5,480,345 A | | 1/1996 | Bethea | 451/234 |
| 5,897,428 A | | 4/1999 | Sakcriska | 451/202 |

OTHER PUBLICATIONS

Olympia Millennium, www.resurfice.com. Apr. 16, 2000, pp. 1-6.
About Zamboni, www.zamboni.com, 1997-2002, pp. 1-12.
Mueller's Company Website, www.charlesmueller.com, pp. 1-8, shows blade grinding services using blade sharpening equipment believed available as prior art before Nov. 26, 2002.

* cited by examiner

*Primary Examiner*—Robert A. Rose
(74) *Attorney, Agent, or Firm*—Brian S. Steinberger; Law Offices of Brian S. Steinberger, P.A.

(57) ABSTRACT

Blade sharpener apparatus and method for ice resurfacing and paper cutting machines includes a table for laying a longitudinal blade in a stationary position thereon. A moveable carrier assembly attached to the table has a drill press power head that is lowered from a raised position so that a rotatable sharpening wheel is positioned at a selected angle against the edge of the blade. A stabilizing guide can slide under the table while the sharpening wheel and an additional guide wheel rolls across the longitudinal blade. Liquid can continuously cool the blade sharpening, and can be recycled for reuse. Another embodiment eliminates the rotating guide wheel, and attaches the carrier to the table so that only the rotating wheel contacts the blade. A hinge can support the carrier, and be adjustable by a rotatable bolt type member to different sharpening angles. A threaded guide rod can be rotated in place along the table so that a mateable threaded portion on the carrier can move along the guide rod. Power to operate the sharpening wheel and the moveable carrier can be supplied by electrical motors, and the like.

23 Claims, 19 Drawing Sheets

START 400
200
300

FINISHED

SHEAR BLADE SHARPENER METHOD AND APPARATUS

This invention relates to blades, and in particular to methods and apparatus for sharpening blades for use with mobile ice resurfacing machines, paper cutting machines, and the like, and this invention is a Continuation-In-Part of U.S. patent application Ser. No. 10/304,201 filed Nov. 26, 2002.

BACKGROUND AND PRIOR ART

Large blades used in mobile ice surfacing machines and those used on paper cutting machines get worn out and dull from their constant extended use over time. These large, expensive, heavy blades which can be up to several feet or more in length often require constant sharpening maintenance to be useful.

Mobile ice surfacing machines, such as Zamboni® are well known for resurfacing ice rink surfaces. Due to the continuous use by ice skaters and the like, indoor and outdoor ice rinks typically require refurbishing their ice surfaces on a regular basis. Over time the sharp edges on ice skates tend to cut into and can gouge the ice surfaces causing uneven surfaces that can be both undesirable and dangerous to the skaters. Also controlling the energy costs in the rinks requires the ice surfaces be maintained at proper thicknesses. Because of their large surface areas mobile ice resurfacing machines have been developed that can traverse and constantly resurface the large ice rink surfaces. These ice resurfacing machines use large longitudinal blades of approximately five to seven feet in length that can weigh up to fifty pounds to eighty pounds or more. The ice resurfacing machines use these large blades to shave and plane the ice surfaces, and also pickup residual snow caused from the shaving. See for example, U.S. Pat. No. 3,917,350 to Bricher. Since the ice surfaces being resurfaced are hard and can include uneven surfaces, the blades on the ice resurfacing machines tend to become worn down and become dull very quickly usually after only five to seven days of use. Using these dull blades is unacceptable since the dull blades can result in rough and wavy surfaces which can be dangerous to skaters and also result in improper pickup of snow off the ice surfaces. The problem arises as to how to sharpen these large longitudinal blades on the ice resurfacing machines. In the United States alone there are an estimated 2,800 ice rinks and in Canada alone there are an estimated 5,000 to 6,000 ice rinks that each have their own ice resurfacing machines that need to have their blades resharpened over time.

The general technique to fix the dull blades is to physically remove the blades from the resurfacing machines and transport them to machine shops that have massive edge sharpening machines. Typically these machine shops will use a large hydraulic type sharpening machine that can weigh upwards of 10,000 pounds or more, can cost up to $100,000 or more, and require space of at least 168 inches in length or more to be used. Further, these heavy industrial machines require substantial training time and expense they can be dangerous to operate, and need expensive maintenance plans to be useful for the ice rinks. Thus, these large hydraulic machines would not be a practical investment for the typical ice rink that needs to have their ice resurfacing machine blades regularly resharpened.

Generally, ice rinks tend to ship out their blades to the machine shops to be resurfaced. However, the act of shipping the blades results in the blades being days and weeks out of commission. In order to send out blades to the machine shops, the ice rinks generally need to keep several blades on hand while the dull blades are being sent out for resharpening services so that their ice resurfacing machines can stay in constant operation. Thus, the headache exists in time, manpower, and shipping costs for having to physically transport dull blades out to remotely located machine shops. Furthermore, the remotely located machine shops do not effectively return sharpened blades having a uniform sharpness. Thus, many resharpened blades must be resent out again. Still furthermore, the machine shops tend to take off in excess of approximately 1/32 to approximately 1/16 of an inch of the surface of the blades during the resharpening operation, thus, taking off more metal than is generally needed usually after having to do several passes or more during the resharpening operation. The excessive amounts of blade material being removed further results in a shorter lifespan of the blades.

Also by sending out the blades for resharpening, the ice rink operators and their employees do not directly see the results of when their actions cause unnecessary nicks to the blade that requires additional costs and expenses of how much more work needs to done to remove nicks that have been caused by driving the mobile ice resurfacing machine onto the threshold when coming off the rink. The mobile machine operator does not usually realize that when the blades hit this threshold extra nicks are made onto the blade that also must be fixed by additional grinding which also causes further expense and delay in getting the blade back onto the machines.

Thus, the ice rinks can typically spend hundreds of dollars per month with the machine shops to resharpen their blades, and also fix unnecessary problems that they do not directly see the problems they cause, such as nicks from poor driving on the ice.

Some alternative solutions to resharpening blades have centered on using a disposable ice resurfacing blades. See for example, U.S. Pat. No. 4,705,320 to Zamboni. However, these blades are not reusable and still would require the user have several blades in stock. While eliminating the shipping to machine shops function, disposable blades could end up costing as much if not more than traditional machine shop sharpening operations since the cost for having to constantly repurchase new disposable blades on a regular basis must be factored in.

The inventors are aware of other types of various blade sharpening machines. See for example, U.S. Pat. No. 3,834,319 to Kastenbein; U.S. Pat. No. 4,069,620 to Sakcriska; U.S. Pat. No. 4,235,050 to Hannaford et al.; U.S. Pat. No. 4,241,544 to Hampton; U.S. Pat. No. 4,294,043 to Sakcriska; U.S. Pat. No. 4,392,332 to Sakdcriska; U.S. Pat. No. 5,127,194 to Jobin; U.S. Pat. No. 5,480,345 to Bethea and U.S. Pat. No. 5,897,428 to Sakcriska. However, these devices are generally used to sharpen small items such as ice skates, and cannot overcome all the problems with the prior art techniques of sharpening blades on ice resurfacing machines described above.

Similarly, large blades are used in paper cutting machines, which also become dull and unusable after their constant use. The blades used in the paper cutting machines have similar problems to those described above in relation to ice resurfacing blades.

Thus, the need exists for solutions to the above problems with the prior art.

SUMMARY OF THE INVENTION

A primary objective of the invention is to provide a method and apparatus for resharpening blades on ice resurfacing and paper cutting machines without having to physically transport the blades to be resharpened to remotely located machine shops.

A secondary objective of the invention is to provide a method and apparatus for resharpening blades on ice resurfacing machines and paper cutting machines that is less expensive and time demanding than sending out blades to machine shops.

A third objective of the invention is to provide a method and apparatus for resharpening blades on ice resurfacing machines and paper cutting machines using a machine that is substantially smaller, lighter and less expensive than large machines used by blade resurfacing and paper cutting blade machine shops, which allows for ice rinks and paper cutting operations to have their own ice resurfacing machines.

A fourth objective of the invention is to provide a method and apparatus for resharpening blades on ice resurfacing machines and paper cutting machines using a machine that is easy and safe to operate, and requires substantially less training and is less dangerous than large machines currently used by blade resurfacing and paper cutting blade machine shops.

A fifth objective of the invention is to provide a method and apparatus for resharpening blades on ice resurfacing machines and paper cutting machines that provides a more uniform sharpness within one to two passes over the blade.

A sixth objective of the invention is to provide a method and apparatus for resharpening blades on ice resurfacing machines and paper cutting machines that takes off less blade material than typical large machine shop blade resharpeners and which results in longer lifespan than blades sharpened by machine shop machines.

A seventh objective of the invention is to provide a method and apparatus for resharpening blades on ice resurfacing machines and paper cutting machines that is more practical for effectively recycling old blades than using disposable type blades.

An eighth objective of the invention is to provide a method and apparatus for resharpening blades on ice resurfacing machines and paper cutting machines that allows a blade end user of these machines to control the cut so as to grind out as little as needed to get the blade back to a desired sharpness.

A first preferred embodiment of the blade resurfacing apparatus for resurfacing a longitudinal blade from a mobile ice resurfacing machine and paper cutting machine can include a table top surface for allowing the longitudinal blade to rest in a stationary horizontal position thereon, the longitudinal blade having a length that fits within a length of the table top surface, and a sharpening wheel for rolling along an upper surface edge of the stationary blade for sharpening the edge of the blade to a selected uniform sharpness. The apparatus can further include a guide foot having a slidable surface material such as but not limited to smooth plastic and the like, for passing along below the table top surface while the wheel is rolling in order to stabilize sharpening of the edge of the blade. The apparatus can further include a lever handle for lowering the sharpening wheel from a raised position to be abutted against the edge of the blade in a lowered position.

Additionally, coolant can be applied over and underneath the blade. A trough on the table top surface and a pump can be used to continuously recycle the coolant.

The apparatus can sharpen blades on blade resurfacing machines to a uniform sharpness of approximately 24 to approximately 26 degrees by moving rolling stone wheel in as little as a single pass over the blade. The apparatus can be used for grinding no more than approximately 0.025 inches off the edge of the blade.

The novel apparatus can include novel dimensions having an overall length of less than approximately 120 inches and an overall weight of less than approximately 250 pounds.

The novel apparatus can be supported over a floor surface by removable stands positioned beneath the table top surface.

Different length and width blades can be sharpened with the apparatus by using spacer(s) that can be positioned to at least one end of the stationary blade on the table top surface, so that the length of the blade and the table top surface are substantially identical.

Novel methods for resharpening a longitudinal blade from a mobile ice resurfacing machine, include supporting a longitudinal blade in a horizontal position on a table top surface, positioning a sharpening stone on a longitudinal edge of the blade and rolling the stone no more than three passes over the longitudinal edge of the blade to form a uniform sharpness in the longitudinal edge of the blade. The stone can be lowered with a rotatable handle such as those found on drill presses, and the like.

Additional methods steps can include cooling surface(s) of the blade and even recycling the coolant fluid over time for reuse.

Furthermore, the novel method can include stabilizing the sharpening stone while it moves across the blade, and allow for sharpening the blade edge to a uniform sharpness of approximately 24 to approximately 26 degrees by moving the blade in as little as a single pass over the blade length, and additionally grinding no more than approximately 0.025 inches off the edge of the blade.

The invention can include sizing the apparatus with spacer(s) so that different sized blades can be sharpened. Additional novel method steps allow for easily mounting the table portion of the invention over removable stands for easy assembly and use.

A second preferred embodiment of the invention can allow for a guide rod having external threaded surface to be mounted to the side of the table supported trough, where the rod is rotated in place. The underside of the carrier can include a hollow member such as a not type member with internal threads so that the rotation of the threaded rod moves the carrier alongside of the table. Unlike the first embodiment, the second embodiment does not use a separate wheel/roller member that rotates on top of the blade, or underneath the table. The carrier can include a slidable clamp which wraps about the rear wall of the trough, and a spring loaded foot member which wraps underneath a table edge which both have a slidable surface in order to allow the carrier to freely move about the trough. Additionally, the angle of the sharpening wheel can be easily and selectively adjusted by using an adjustable hinge member between the control tower portion of the carrier and the trough mount components (slidable clamp for wall trough, and slidable foot member). The hinge can be selectively adjusted by rotating a member such as a bolt which separates and contracts the upper portion of the hinge from the lower portion of the hinge. The second embodiment can also use recyclable coolants when being operated.

The invention can be used for a wide variety of blade sharpening operations. For example, ice resurfacing blades, paper cutting blades, fabric cutting blades and/or foil cutting blades can be sharpened with the novel invention.

Further objects and advantages of this invention will be apparent from the following detailed description of a presently preferred embodiment which is illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

First Embodiment

Figure 1:
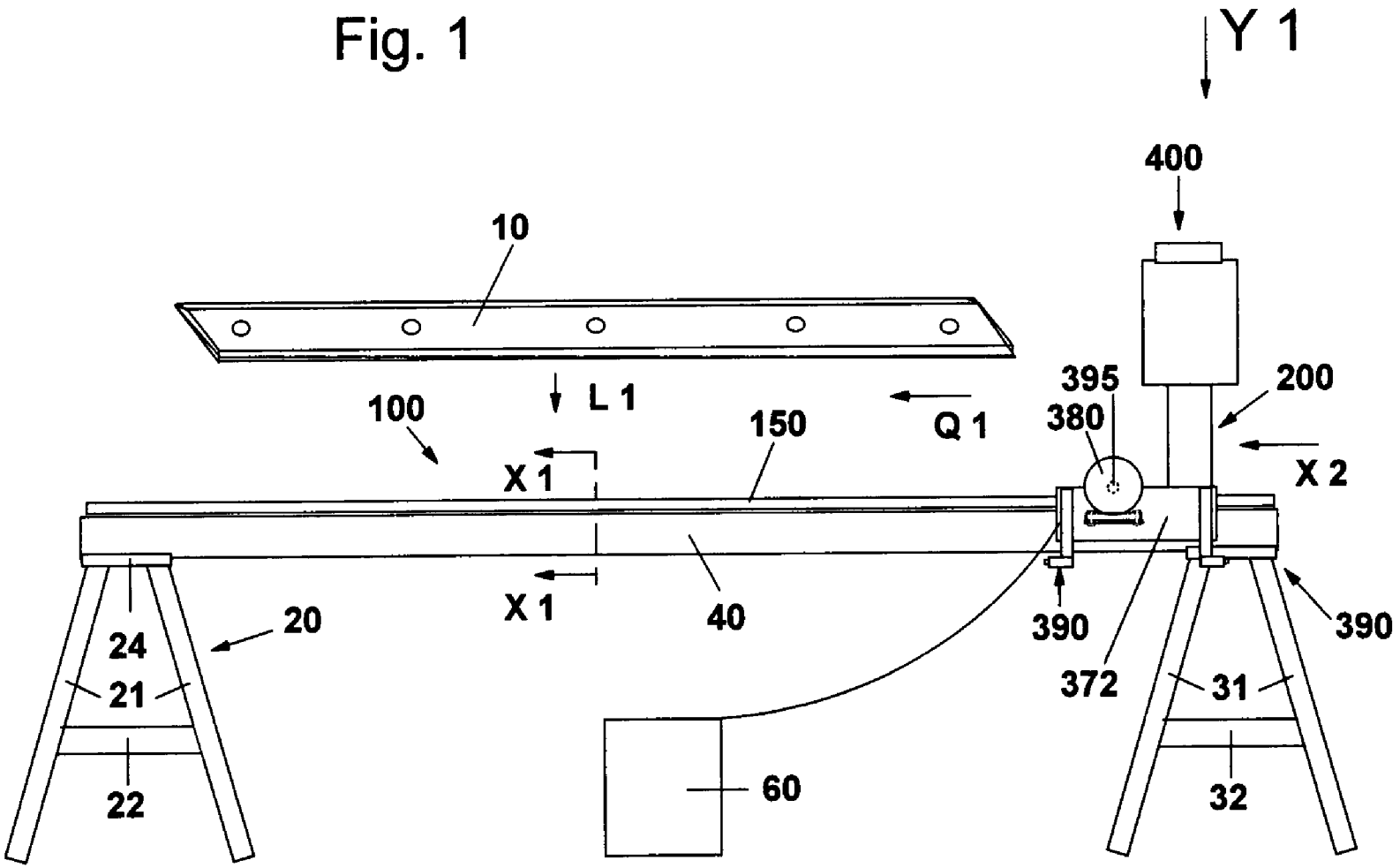
FIG. 1 shows a side view of a first preferred embodiment of the ice blade resurfacing apparatus with blade raised above the table with coolant recycling trough, having a control panel and lowerable sharpening head and carrier assembly at one end of the table with the blade being lowerable in the direction of arrow L1.

FIG. 1 shows a side view of a first preferred embodiment of the ice blade resurfacing apparatus 1 with blade 10 raised above the table 100 and coolant recycling trough 40 along with control panel 400 and lowerable sharpening head 200 and carrier assembly 300 at one end of the table 100 with the blade 10 being lowerable in the direction of arrow L1. The novel sharpening apparatus 1 can be used with a blade 10 that can have a dimensions of approximately ½ inch thick, approximately 5 inches wide and approximately 77 inches long, and weigh approximately 80 pounds. The overall apparatus 1 can have an overall length of approximately 10 feet (approximately 120 inches).

Figure 2B:
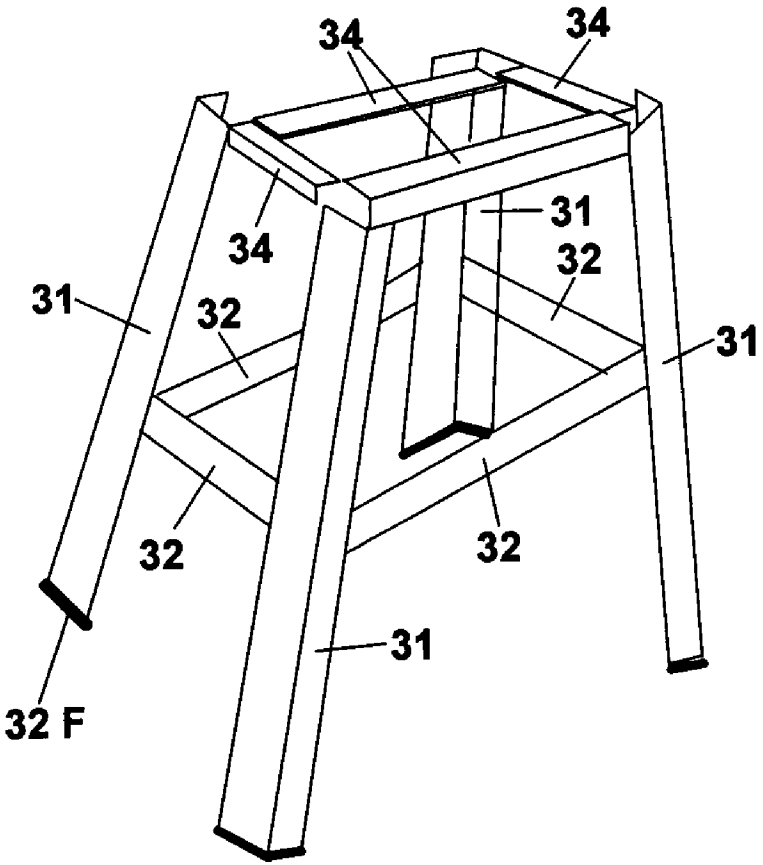
FIGS. 2A and 2B are perspective views of the stands that support the table top of FIG. 1.
Figure 2A:
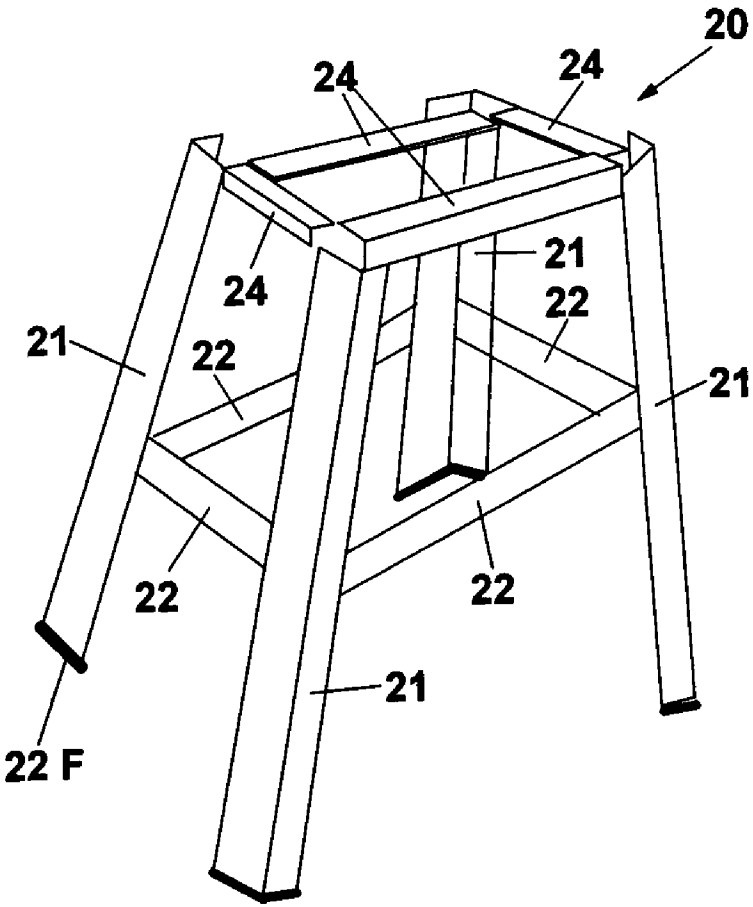

FIGS. 2A and 2B are perspective views of the stands 20, 30 that each support the table top 10 of FIG. 1. Each of the stands 20, 30 can have a four legs 21, 31 that expand outward to bottom feet portions 22, 32 that can include rubber type sleeves for traction effects on a ground surface. Each of the legs 21, 31 can have a perpendicular cross-section that form a stationary brace effect. Each of the legs 21, 31 can be attached to one another by four horizontal braces 22, 32 that form a rectangular type configuration. A second set of four horizontal braces 24, 34 attached to upper ends of the legs 21, 31 form a rectangular type configuration for supporting an undersurface 42 of the trough 40 which is shown in greater detail in reference to FIG. 4. Each of the stands 20, 30 can support the table top 100 approximately 30 inches (2' 4") above the ground surface, with a lower expanded bottom width of approximately a few feet.

Figure 3:
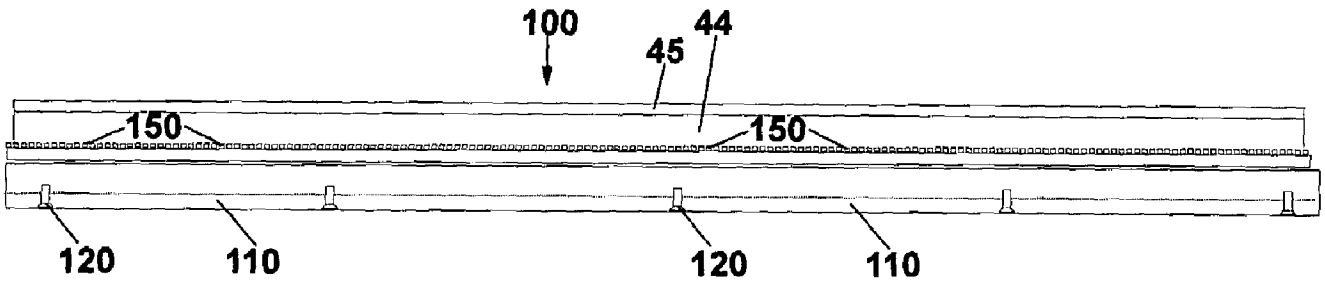
FIG. 3 shows a front view of the table top of FIG. 1 which supports the blade.
Figure 4:
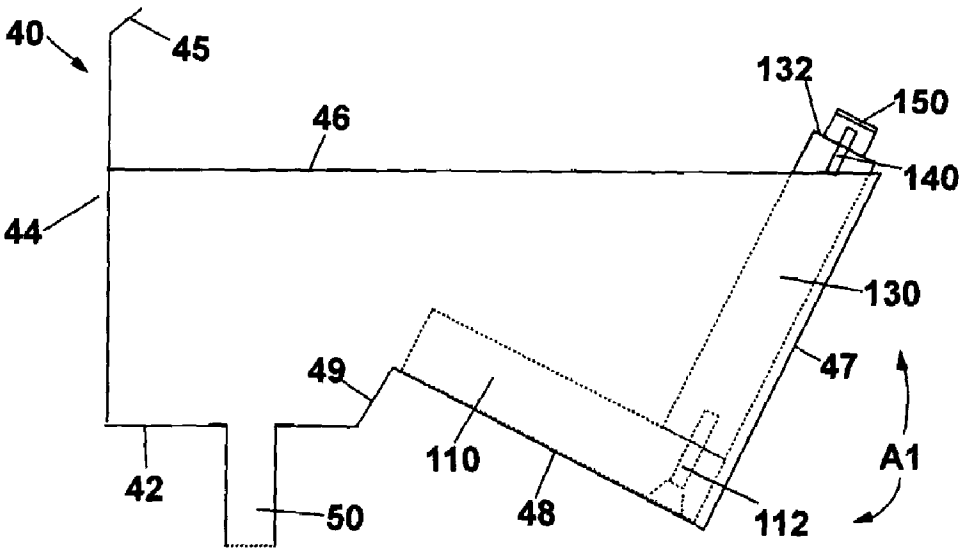
FIG. 4 is a cross-sectional view of the table top and coolant recycling trough of FIG. 1 along arrows X1.

FIG. 3 shows a front view of the table top 100 of FIG. 1 which supports the blade 10. FIG. 4 is a cross-sectional view of the table top 100 and trough 40 of FIG. 1 along arrows X1. Referring to FIGS. 3–4, table top 100 includes lower rectangular leg bar 110 which is attached to rear rectangular leg bar 130 by fasteners 120 such as but not limited to bolts, and the like, so that lower leg bar 110 and rear leg bar 130 are oriented substantially perpendicular to one another, and together be tilted at an angle A1 of approximately 45 degrees from the ground surface. Leg bars 110, 130 can be formed from metal such as aluminum, and the like. Extending upward from upper edge 132 of rear leg bar 130 can be a row of gear rack teeth 150 attached to the rear leg bar 130 by fasteners 140 such as but not limited to bolts, and the like.

Referring to FIGS. 1, 34 and 4, trough 40 can support coolant fluid such as but not limited to water, and the like, inside, and be formed from metal such as but not limited to aluminum, and the like. Trough 40 can include horizontal bottom 42 which rests on the upper rectangular supports 24, 34 of stands 20, 30. A front wall 44 of the trough 40 can have an inwardly bent splash guard 45. Trough 40 can further include end walls 46 on opposite ends, and a rear angled wall 47 which fits against rear leg bar 130, which connects to seat wall portion 48 which rests on bottom leg bar 110 and angled step 49 which abuts against end 112 of bottom leg bar 110, and which connects to bottom 42. A drain 50 can extend downward from for draining fluid from the trough 40, which will be explained later in greater detail.

Figure 5B:
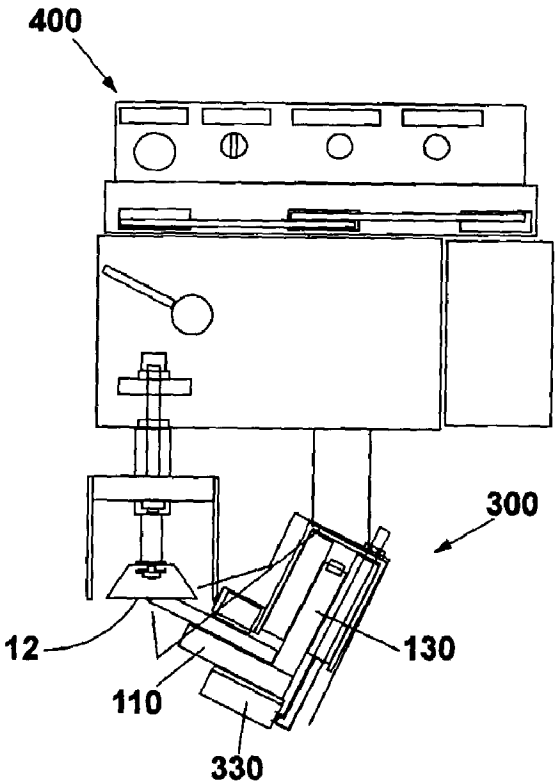
FIG. 5B the sharpening head of FIG. 5A moved downward in the direction of arrow D1 to a lowered position adjacent to the edge of the blade to be sharpened.
Figure 5A:
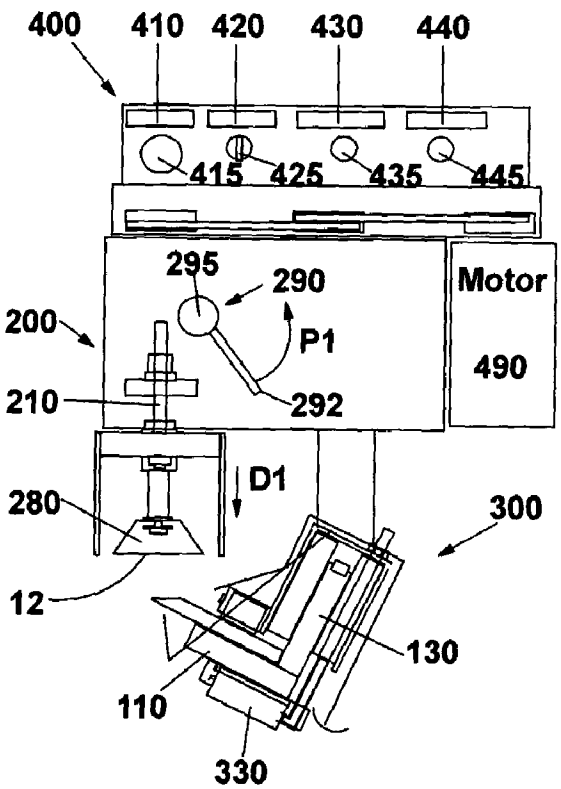
FIG. 5A shows an end view of FIG. 1 along arrow X2 of the carrier assembly about the table top and the control panel with the sharpening head in a raised position.

FIG. 5A shows an end view of the FIG. 1 along arrow X2 of the carrier assembly 300 about the table top 100(110, 130) and the control panel 400 with the sharpening head 200 in a raised position.

FIG. 5B shows the end view of FIG. 5A with the sharpening head 200 moved downward in the direction of arrow D1 to a lowered position adjacent to the edge 12 of the blade 10 to be sharpened.

Figure 6:
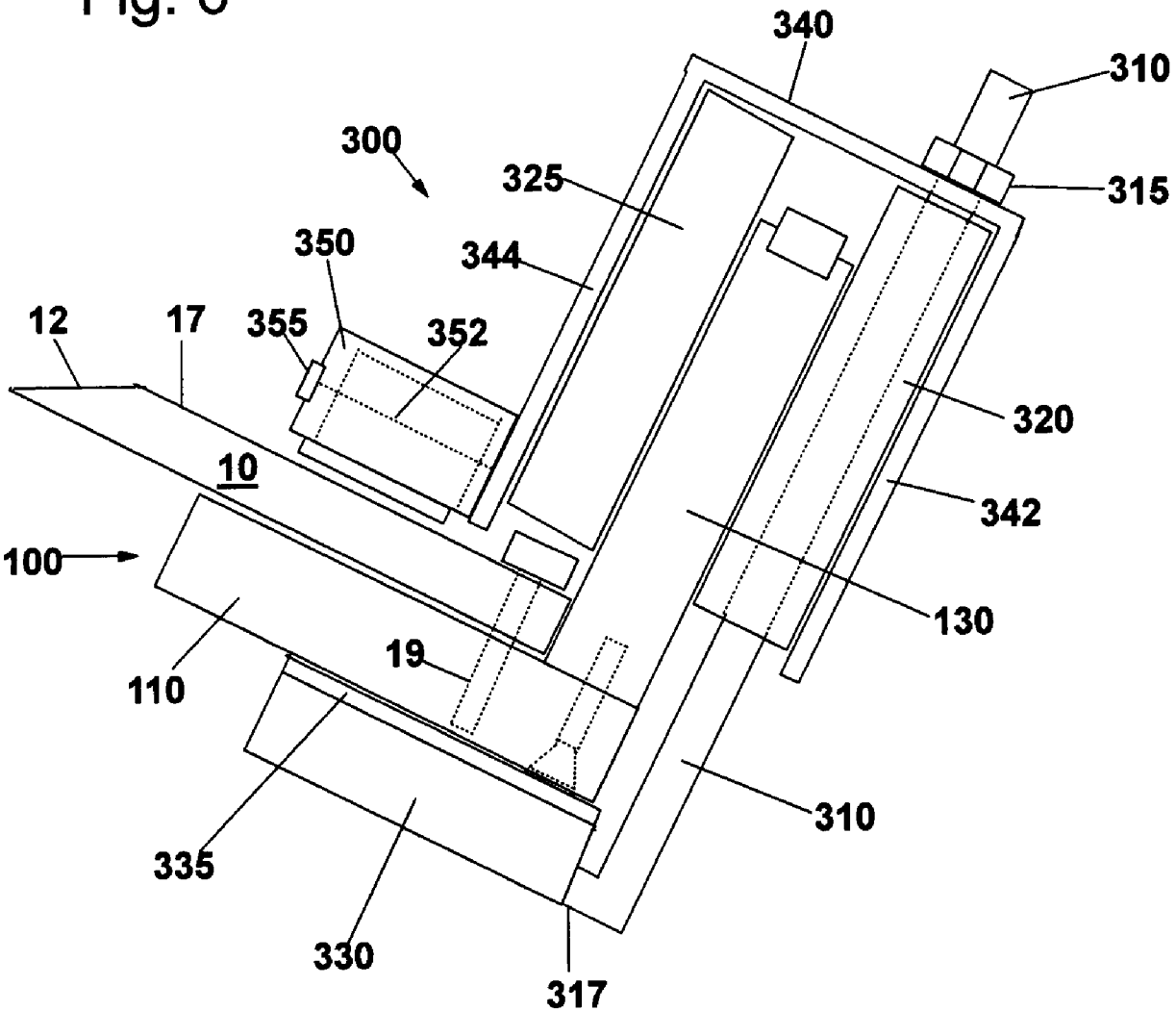
FIG. 6 is an enlarged view of the carrier assembly about the table top of FIGS. 5A–5B.

FIG. 6 is an enlarged view of the carrier assembly 300 about the table top 100(110, 130) of FIGS. 5A–5B.

Figure 7:
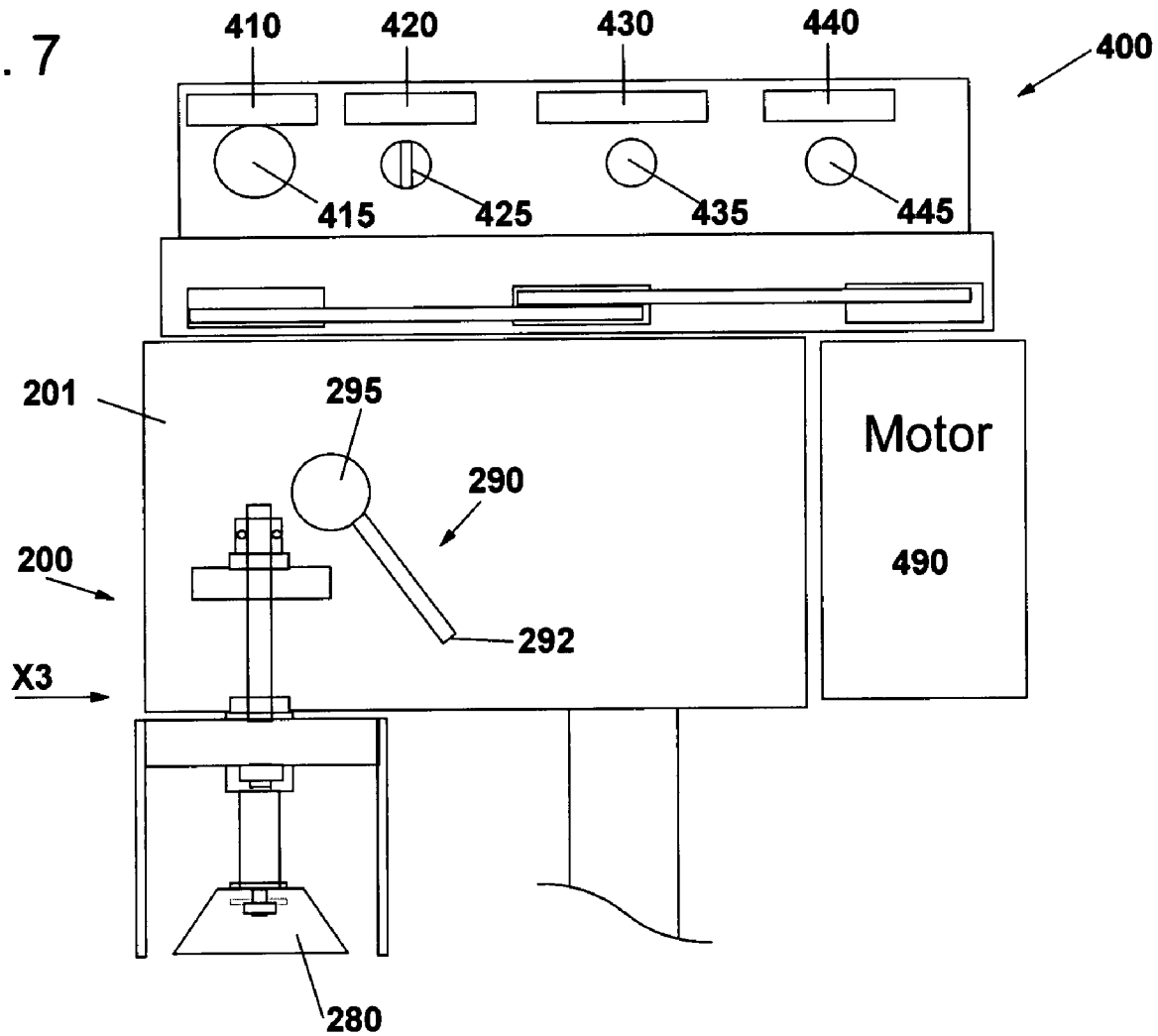
FIG. 7 is an enlarged view of the control panel and sharpening head of FIGS. 4A–4B.

FIG. 7 is an enlarged view of the control panel 400 and sharpening head 200 of FIGS. 4A–4B.

Control panel 400 will now be described in reference to FIGS. 5A, 5B, 6 and 7. Control panel 400 can include an on/off power control 410 for supplying power to the entire apparatus 1 having a push button 415, a traverse switch 420 which allows the sharpening head 200 to start moving in a horizontal direction across the blade 10 in a single pass by rotating a switch 425, a on and off button 435 for initiating the grinding stone wheel 280 on the sharpening head 200 to start rotating, and another on/off switch 445 for engaging the coolant recycling pump 440. Motor 490 such as a 380/110 volt motor can provide power to the grinding stone wheel 280 of sharpening head 200. The invention can use any one of pressable button switches, toggle switches, rotatable switches and the like, for the control panel 400.

Figure 8B:
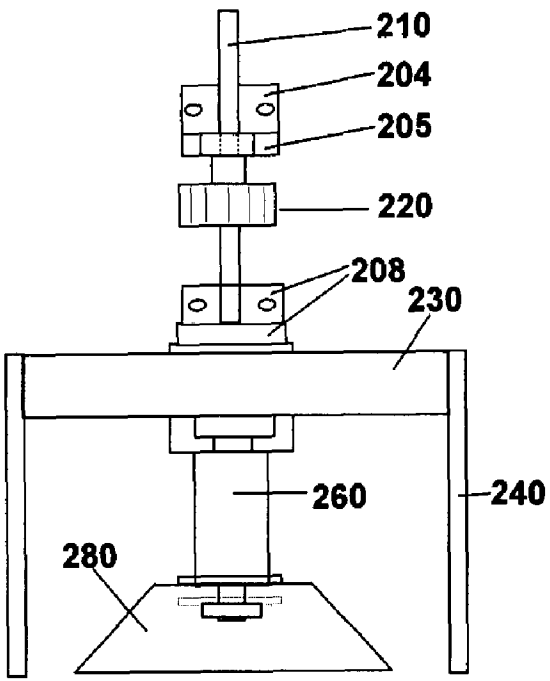
FIG. 8B a side view of the depth adjusting knob for the sharpening head assembly of FIG. 8A along arrow X4.
Figure 8A:
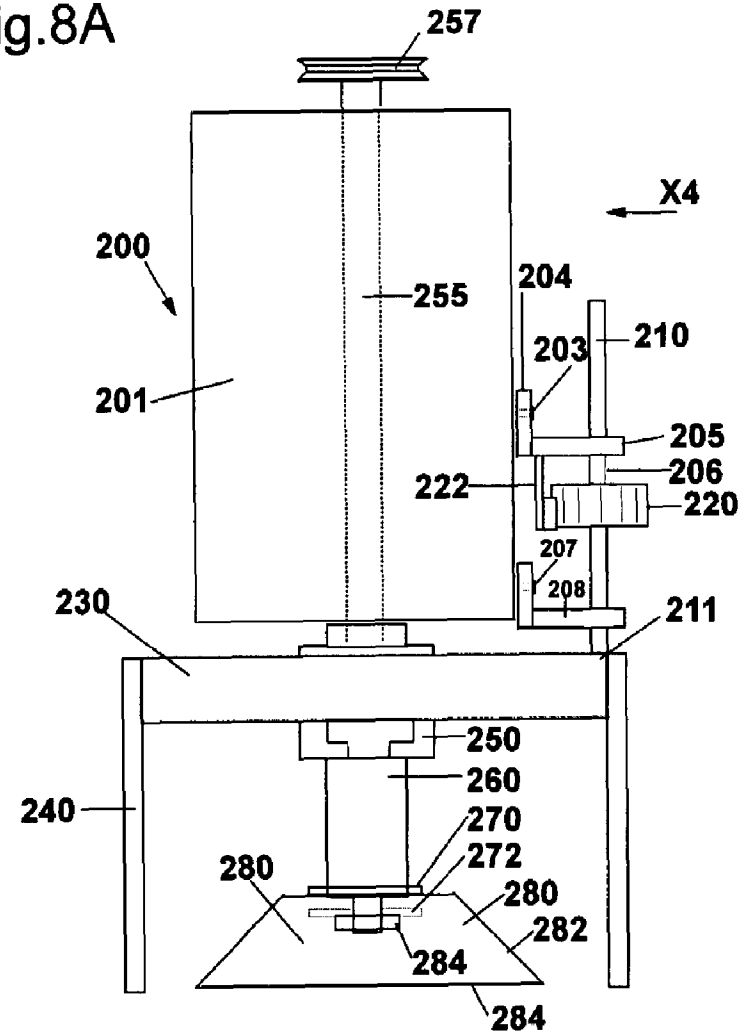
FIG. 8A is an enlarged view of the depth adjusting knob for the sharpening head assembly of FIG. 7 along arrow X3.

FIG. 8A is an enlarged view of the depth adjusting knob for the sharpening head assembly 200 of FIG. 7 along arrow X3. FIG. 8B a side view of the depth adjusting knob for the sharpening head assembly 200 of FIG. 8A along arrow X4.

Lowerable sharpening head 200 will now be described in reference to FIGS. 5A, 5B, 7, 8A and 8B. Sharpening head 200 can include an assembly that can be similar to that of a drill press, and the like, and can include two holder bracket 204, 208 attached to a wall plate 201 by fasteners 203, 207 such as bolts, screws, and the like, that have through-hole openings 205, 209 for allowing a vertical support rod 210 to slide up and down within. Rod 210 can have a threaded exterior surface where a rotatable stop knob 220 can screw about threaded rod 210 and function as a depth adjuster for allowing the grinding wheel when moved downward in the direction of arrow D1 when resting upon edge 12 of the blade 10 be locked in place by rotating knob 220 about threaded rod 210. Grinding stone 280 is fixably attached to the bottom end of rod 210. A transparent cylindrical guard shield 240 can be attached to rod 210 by a solid header portion 230. A nut 250 locks the header portion 230 to rod 210. A rotatable arbor rod 260 is connected to rotating stone 280 by a fastener 274 such as a bolt, and the like, with washer 272 and nut 270. Handle 290 can include an elongated griping portion 292 which pivots about end 295 so that rotating handle 290 counter-clockwise in the direction of arrow P1 moves stone 280 downward in the direction of arrow D1 toward edge 12 of blade 10. At this point stone wheel 280 is close to but does not abut against edge 12 of the blade 10. For example stone wheel 280 can rest approximately ⅜ of an inch above blade edge 12.

The handle 290, raisable and lowerable rod 255, and mount 257 can be those used with traditional raiseable and lowerable drill presses, and the like, such as but not limited to those described in reference to U.S. Pat. No. 4,468,159 to Oster which describes a "Drill Press and Stand", which is incorporated by reference. In a preferred embodiment, the drill press used for these components can be a Jet Drill Press Model # JDP 14MF.

Referring to FIGS. 7, 8A and 8B, rotatable knob 220 can be a plastic fluted knob, which can be locked into position by a spring loaded flute ball 222. In an initial resting position, knob 220 can abut against a lower extending surface 206 of plate 205 of upper bracket 205. Next, as previously described, the handle 290 is rotated to move the stone 280 downward. Next, the knob 220 can be rotated counter-clockwise which in turn causes threaded rod 210 to move downward through brackets 205, 208 so that lower end 211 eventually pushes down on guard base 230 which in turn pushes down grinding stone wheel 280 to abut against blade edge 212. This secondary process of moving the stone wheel 280 downward allows the stone wheel 280 to be held in place (locked) so that it abuts against edge 12 of blade 10 by the spring loaded flute ball 222.

Grinding stone wheel 280 can rotate clockwise in the direction of arrow R with rotating arbor 260 at speeds of approximately 2300 revolutions per minute to sharpen edge 12 of the blade 10. Stone 280 can have a disc shaped configuration with outer flared surface 282 and a lower solid stone surface 284 which is used to grind against and sharpen edge 12 of the blade 10. Flared surface can have an angled surface of approximately 24 degrees, 26 degrees, and any other selected angled edge. Stone 280 can be a Norton Flaring cup wheel having 46 Grit and an H-hardness level. Switch 435 on control panel 400 can be used to turn on and off the motor for rotating grinding stone wheel 280.

Figure 10:
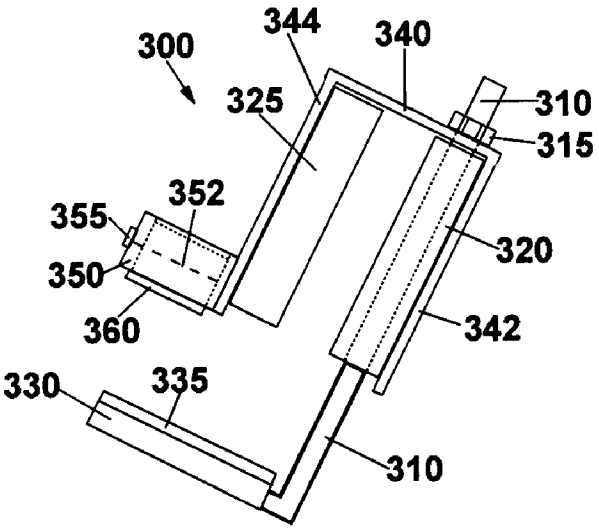
FIG. 10 shows the carrier assembly of FIG. 6 separate from the table top.

FIG. 10 shows the carrier assembly 300 of FIG. 6 separate from the table top 100.

Carrier assembly 300 will now be described in reference to FIGS. 5A, 5B, 6 and 10. Carrier assembly 300 includes stabilizing foot threaded rod attachment 310, with a nut 18 screwed thereon, and guide 320 with hollow internal threaded walls threadably attached to threaded rod attachment 310 with U-shaped carrier frame 340 therebetween. Rear leg portion 342 of frame 340 can be fixably attached to rest against guide 320, while forward solid guide 325 is fixably attached to rest against an inner surface of forward leg portion 344 of frame 340. Lower perpendicular L-shaped leg 317 of rod attachment 310 can include a stabilizing foot 330 with an upper pad portion 335 formed from a slidable material such as polished plastic, and the like, that can slide under lower leg 110 of table 100. A forward facing bracket 350 has bolt through a front portion which has an axle portion 352 for allowing resilient roller 360 such as but not limited to rubber, and the like, to roll thereon. Roller 360 can roll on top of upper surface 14 of blade 10. As shown in FIG. 6, fastener(s) 19 such as bolts, and the like, can fixably mount the blade 10 in a stationary position to lower table leg 110 prior to sharpening blade edge 12.

Figure 9:
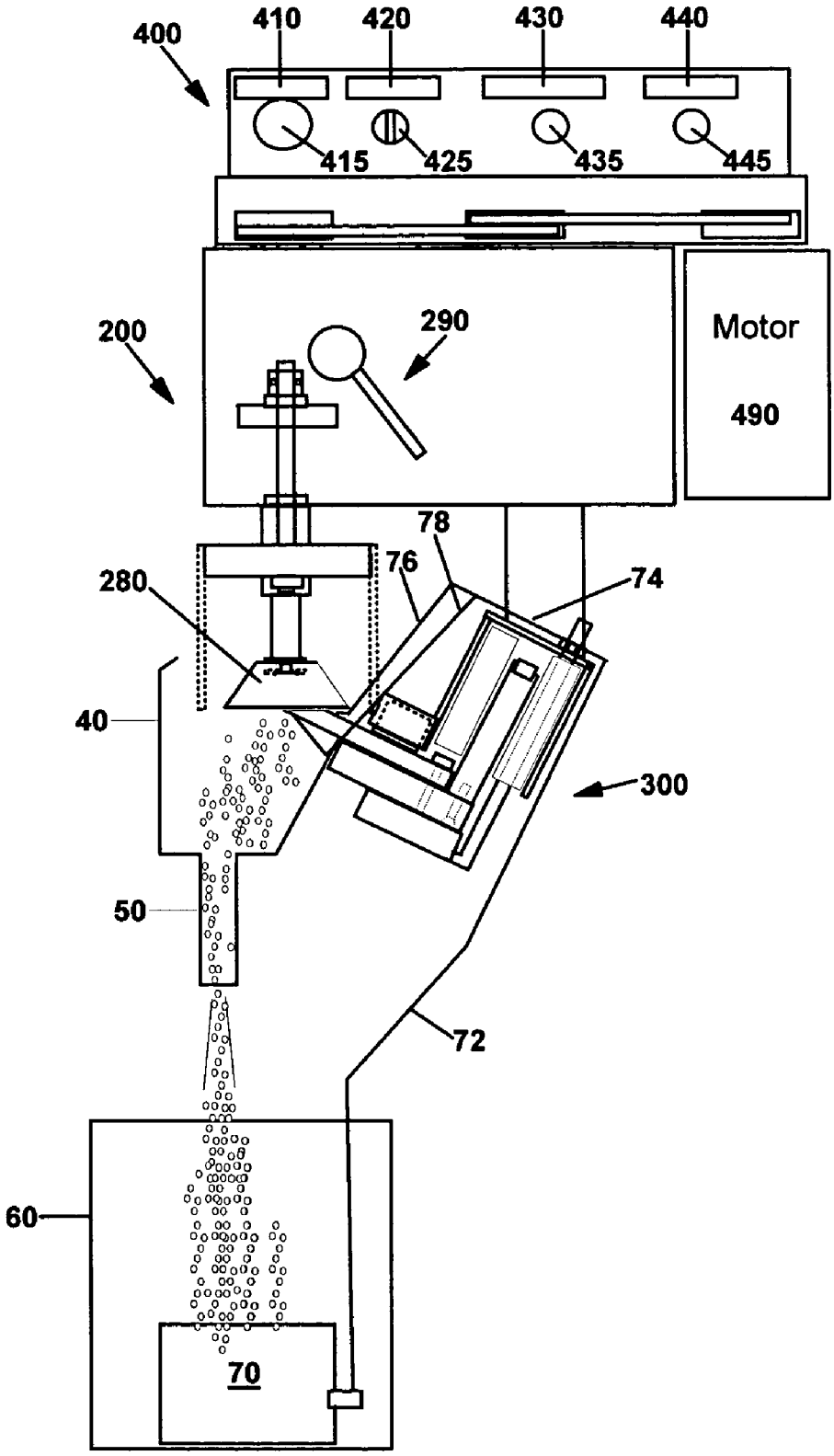
FIG. 9 shows an end view of table, control panel, sharpening head assembly, carrier assembly, recycling trough and recycling bucket of FIG. 1 along arrow X2 without the table support stands.

FIG. 9 shows an end view of table 100, control panel 400 sharpening head assembly 200 carrier assembly 300, recycling trough and recycling bucket 50 of FIG. 1 along arrow X2 without the stands 20, 30.

The recycling coolant system used with the novel invention will now be described in reference to FIGS. 1, 4, 5A, 5B and 9. A catch container 60 such as but not limited to a 5 gallon bucket and the like, can be positioned below drain 50 of trough 40 that is adjacent to table 100. A recycling pump 70 can be placed inside the container 60 and be used to pump coolant, such as water, and the like, at a rate of approximately 5 gallons per minute through lines 72, 74 to spray nozzle line 76 for spraying on top of the blade 10 before the grinding wheel 280, and simultaneously to a spray nozzle line 78 for spraying under the blade 10 in order to constantly cool the blade 10 that is being sharpened. The liquid being sprayed can keep the blade 10 at ambient temperature in order to keep the blade from heating up and eventually becoming cracked from the sharpening operation. Liquid that is sprayed onto the blade can include a synthetic biodegradable fluid such as but not limited to Formular 77 Cool Mist, that can also include a rust resistant additive. Control panel switch 445 can be used to turn on and off the pump 70.

Figure 11:
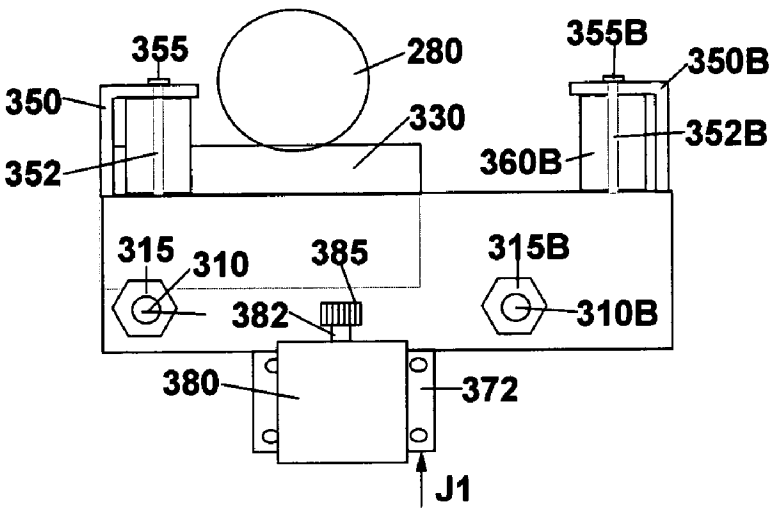
FIG. 11 is a top view of the carrier assembly of FIG. 10 and FIG. 1 also showing the traveling motor.
Figure 12A:
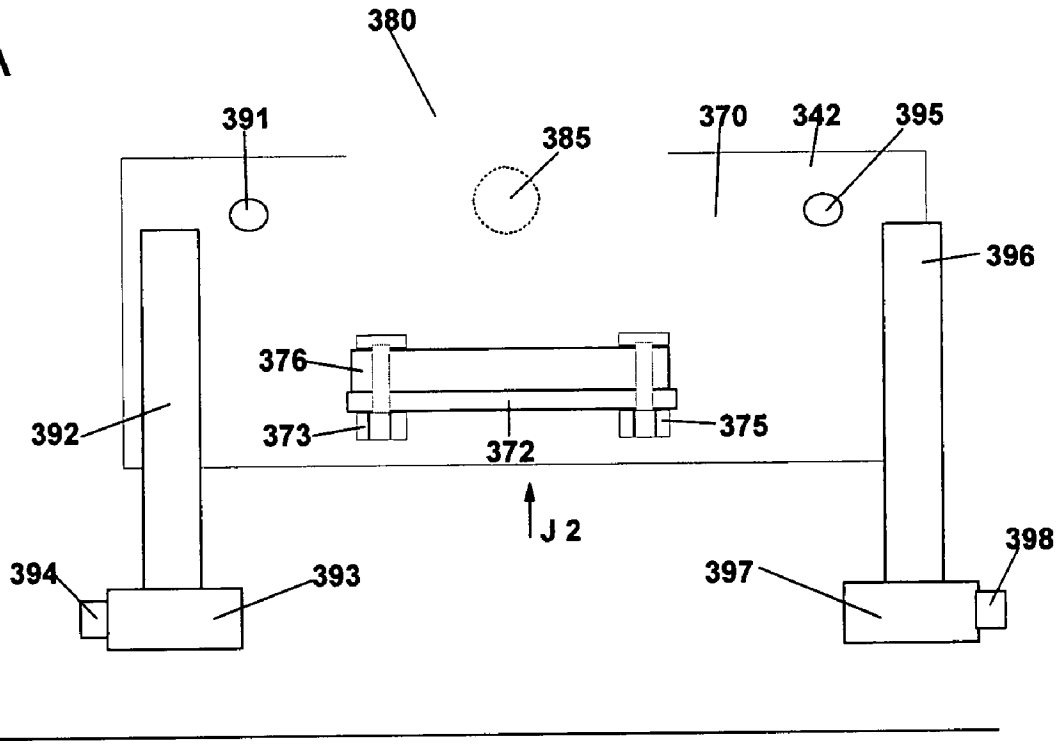
FIG. 12A is an enlarged view of the traversing motor, bracket and limiting switches of FIG. 1 and a side view of FIG. 12A along arrow J1.
Figure 12B:
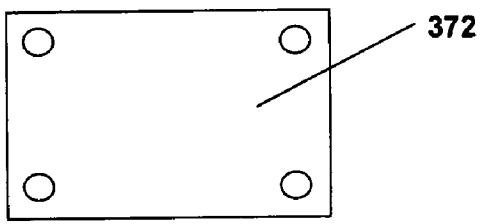
FIG. 12B is a bottom view of the traversing motor attachment bracket of FIG. 12A along arrow J2.
Figures 13A, 13B, 13C, 13D, 13E, 13F, 13G, 13H:
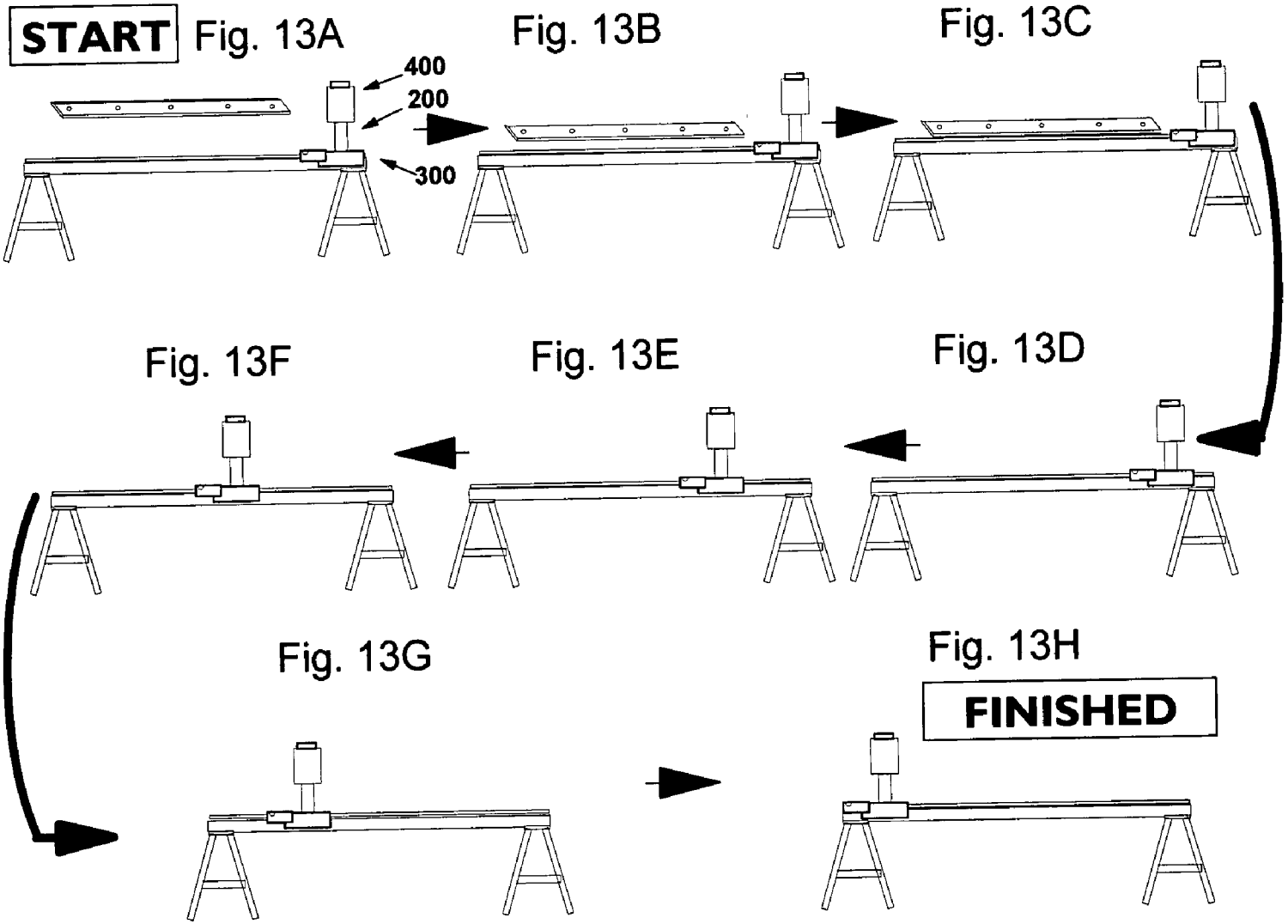
FIGS. 13A, 13B, 13C, 13D, 13E, 13F, 13G, 13H illustrate the different steps that the blade resurfacing machine runs through to form a single pass uniform blade sharpening operation.

FIG. 11 is a top view of the carrier assembly 300 of FIG. 10 and FIG. 1 also showing the traveling motor 380 and foot 330 without the table 100 therebetween. FIG. 12A is an enlarged view of the traveling motor 380, bracket and limiting switches of FIG. 1 and a side view of FIG. 12A along arrow J1. FIG. 12B is a bottom view of the traversing motor attachment bracket 372 of FIG. 12A along arrow J2.

The traversing motor will now be described in reference to FIGS. 1, 3, 6, 10, 11, 12A and 12B. U-shaped bracket 340 can include two forward facing brackets 350, 350B which have bolts 355, 355B with axle portions 352, 352B for allowing resilient rollers 360, 360B to roll thereon, so rollers 360, 360B roll over top surface 14 of blade 10, while stabilizing foot 330 slides beneath table leg 10. Bracket 370 can be attached to leg wall 342 by fasteners 391, 395 such as bolts, and the like. Bracket 370 can have an extension portion 371 which connects to traversing driver motor 380 stacked support brackets 372, 376 that can be fastened to one another by fasteners 373, 375 such as but not limited to bolts and nuts, and the like. A spur gear sprocket 385 is attached by a rotating axle portion 382 to traversing driver motor 380, so that spur gear sprocket 385 mateably rolls over a row of gear rack teeth 150 attached to the rear leg bar 130 of table 100. A pair of limiting switches 390 can be used to automatically stop the moving carrier assembly 300. A left limiting switch 393 extending downward from wall portion 342 can include a left facing spring loaded depressible button 394 that can stop traversing motor 380 from running when carrier assembly 300 abuts against leg 21 of left stand 20. A right limiting switch 397 extending downward from wall portion 342 can include a right facing spring loaded depressible button 398 that can stop traversing motor 380 from running when carrier assembly 300 abuts against leg 31 of right stand 30. The carrier assembly 300 with motor 380 can be initially operated to move in the direction of arrow Q1 by rotating knob 425 of control panel 400 in a clockwise direction. Similarly, rotating knob 425 counterclockwise can cause carrier assembly to move in an opposite direction path.

FIGS. 13A, 13B, 13C, 13D, 13E, 13F, 13G, 13H illustrate the different steps that the blade resurfacing machine runs through in a preferred operation to form a single pass uniform blade sharpening operation.

Referring to FIGS. 1, 13A, 13B, 13C, blade 10 is moved downward on top of table leg 110 of table 10 where it can be bolted down using up to three or more bolts (19 FIG. 6). Next, referring to FIGS. 5A, 5B, and 13D, the power head 200 can be lowered so that grinder wheel 280 rests over blade edge 12 by approximately ⅜ of an inch, by moving handle 290 in the direction of arrow P1. Next, referring to FIGS. 1, 6, 7, and 13D, the grinder motor 490 can be turned on starting the rotating of the grinding wheel 280. Next, the depth of the grinder stone wheel 280 can be adjusted by rotating the fine adjustment knob 220 of FIGS. 8A and 8B so that the stone wheel 280 just barely touches the blade edge 12. Next, referring to FIGS. 1, 7, 9 and 13D with the carrier assembly 300 in the far right position on table 100, the coolant pump switch 445 is turned on starting the pump motor 70 for spraying coolant over the top and bottom of the blade 10. Next, referring to FIGS. 1, 8A, 8B and 13D, the fine adjuster knob 220 can be rotated down one notch so that the grinding wheel presses into the blade edge at a depth of approximately 0.005 inches. Next, referring to FIGS. 1, 7, 11, 13E, 13F and 13G, the traversing motor 380 is turned on by switch 425 of the control panel 400 and the carrier assembly 300 starts to move in a leftward path over the blade 10. Finally, referring to FIGS. 11, 12A, 12B, and 13H, at the end of the full pass, the left limiting switch 392–394 stops the traversing motor 380, and the sharpened blade 10 can be removed from the table 100.

In experiments, the blade 10 is able to be fastened to the table 100 within approximately 5 minutes, and a single pass for sharpening the blade edge 12 takes up to approximately 20 to approximately 25 minutes. The invention can allow for a single pass for sharpening most blade edges 12 on a longitudinal blade 10. Operators using the invention can also make visual inspections to determine if additional pass(es) would be needed by examining cavities, crevices, gulleys on the blade edge 12.

Figure 14:
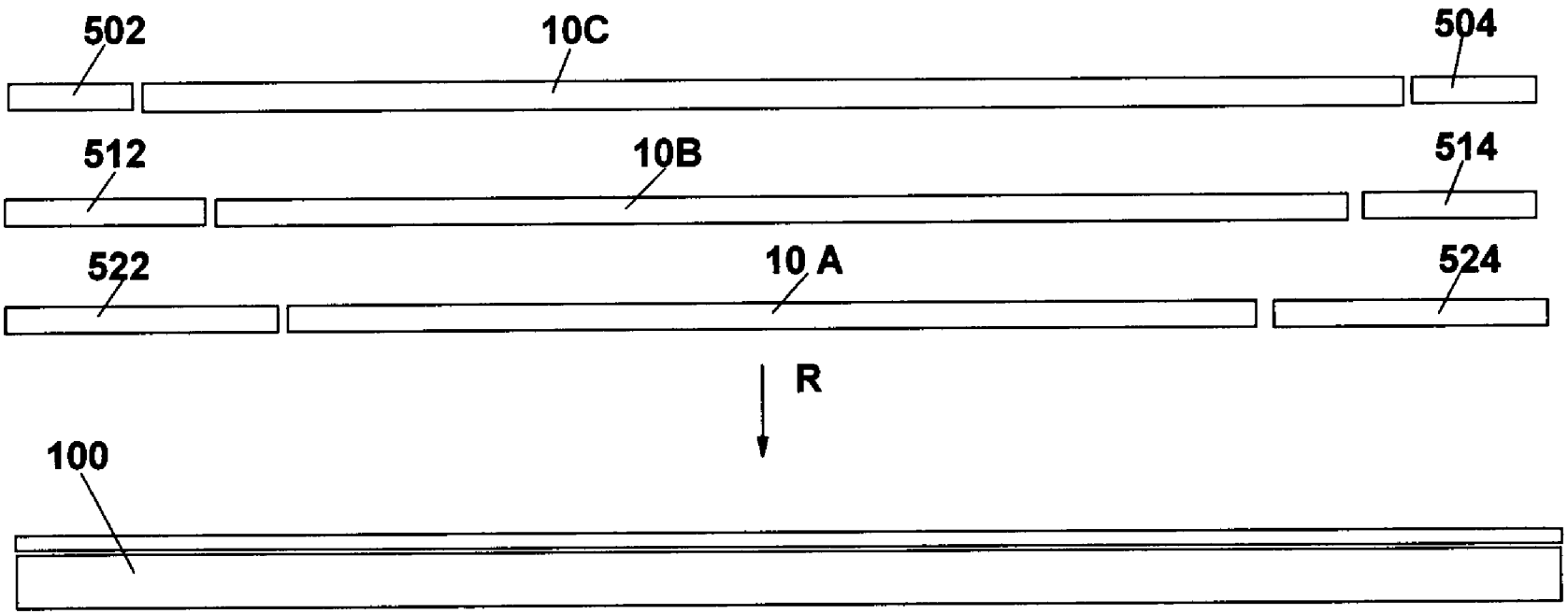
FIG. 14 shows different blade lengths and spacer combinations for the tabletop of FIG. 1.

FIG. 14 shows different blade lengths 10A, 10B, 10C and spacer combinations for the tabletop 100 of FIG. 1. While the novel invention can include a table 100 having a length of approximately 10 feet (120 inches) for sharpening large blades. The invention can use spacers 502/504, 512/514, 522/524 for allowing different sized blades 10A, 10B, 10C to be used on a single table 100. Fasteners such as bolts and the like, can be used to mount the blades 10A, 10B, 10C and spacer combinations 502/504, 512/514, 522/524 on the table 100.

Second Preferred Embodiments

Figure 15:
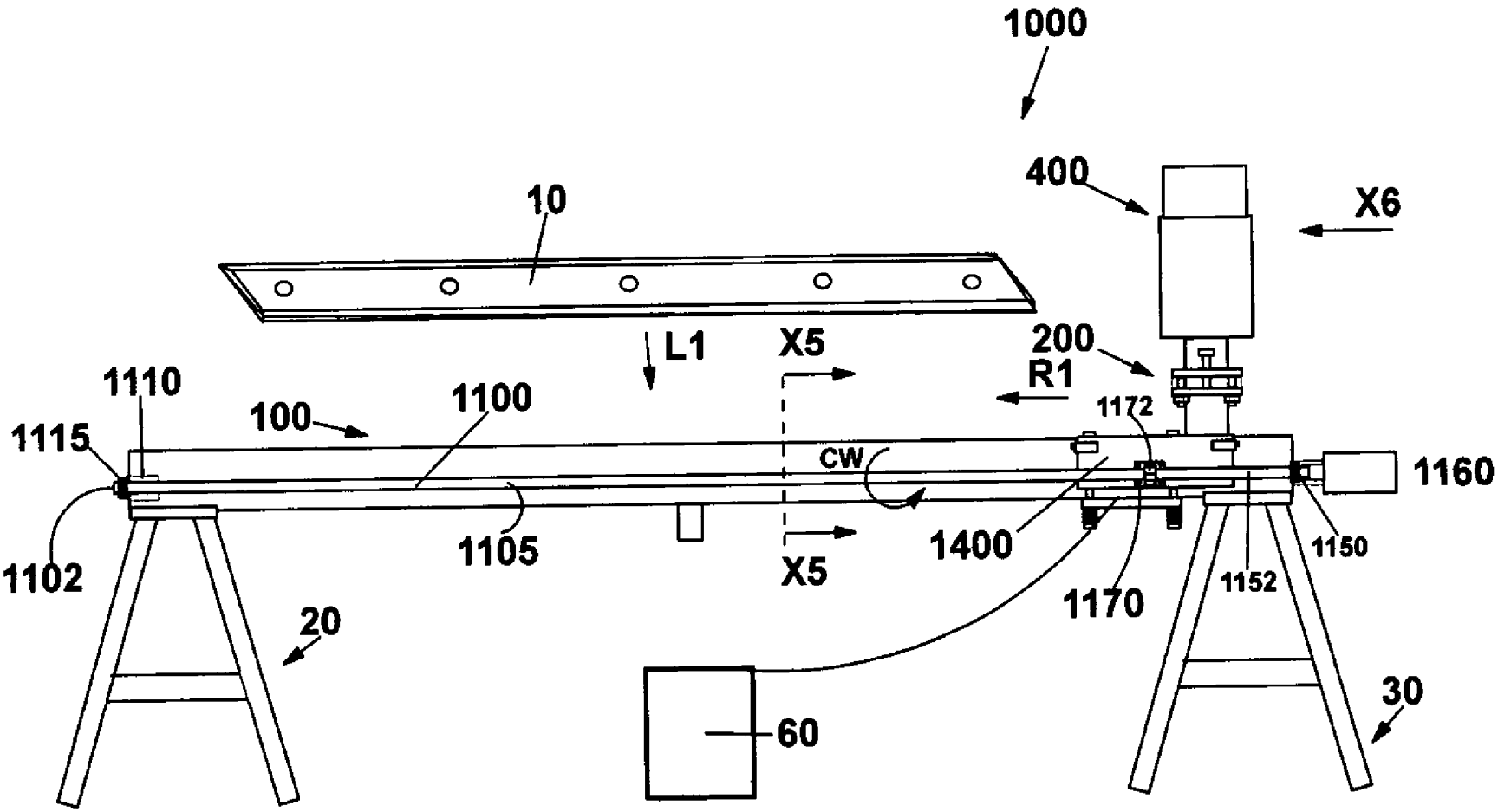
FIG. 15 shows a side view of a second preferred embodiment of the ice blade resurfacing apparatus with lowerable sharpening head and carrier assembly that can run along a guide rod adjacent to the table in the direction of arrow R1.

FIG. 15 shows a side view of a second preferred embodiment of the ice blade resurfacing apparatus 1000 with lowerable sharpening head and carrier assembly 200, 400 that can run along a guide rod 1100 adjacent to the table 100 in the direction of arrow R1. The guide rod 1100 can have external threads 1105, and can be attached at a left end 1102 through a hollow sleeve holder 1110 which can be fixably attached to the side of table 100, with nut fastener 1115 tightly fastened about the end 1102 adjacent to the sleeve holder 1110, so that the guide rod 1100 can slide in place within the sleeve holder 1110. A right end 1152 of the guide rod 1100 can be mounted to another side portion of table 100 by another hollow sleeve holder member 1150. An electrical motor 1160 mounted to an end of the table 100 can be activated by connections to the control panel 400 to rotate the rod 1100 in place next to the table 100.

Figure 16:
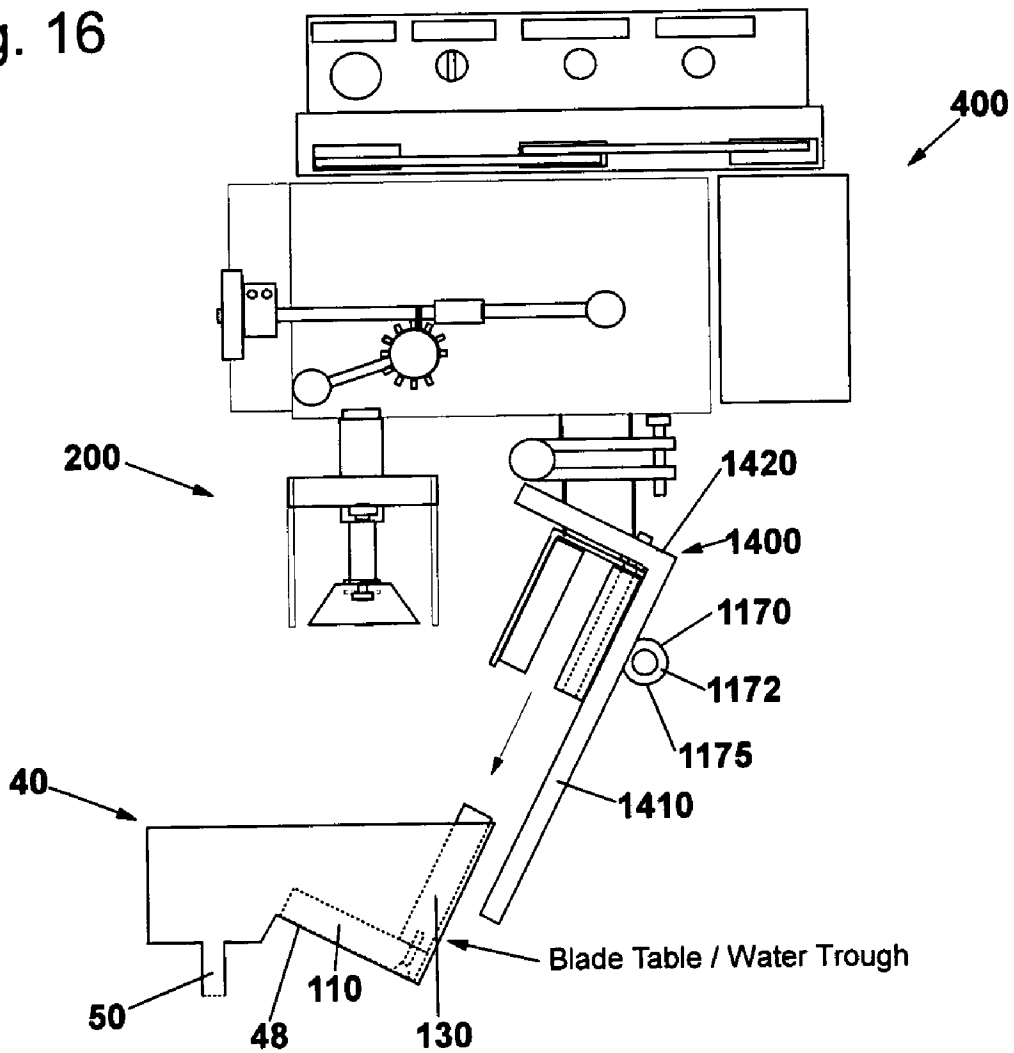
FIG. 16 is an exploded cross-sectional view of FIG. 15 along arrow X5 showing the sharpening head and carrier separated from the trough without the guide foot.

FIG. 16 is an exploded cross-sectional view of FIG. 15 along arrow X5 showing the sharpening head 200 and carrier assembly separated from the trough 40 without the guide foot.

Referring to FIGS. 15–16, a rod-guide bracket 1170 (a side view of which is shown in FIGS. 16, 18, 19A, 19B, 20A, 20B) can be fixably attached to a rear leg member 1410 of an L-shaped support 1400. Bracket 1170 can include a guide nut 1172 on its' exterior surface that has internal surface threads 1175, that are mateable to external threads 1105 of rod 1100, so that rotating the rod 1100 clockwise (CW) causes the carrier assembly components 200, 400 to travel alongside the table 100 in the direction of arrow R1. The remaining components shown in FIG. 15 can be similar to those of the previous embodiment described above.

Figure 17:
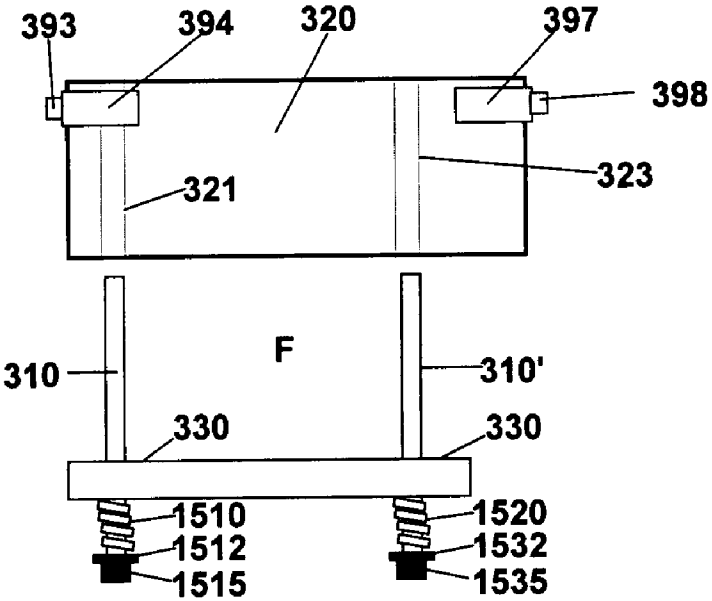
FIG. 17 is an end view of the guide foot being attached to guide member of the carrier assembly of FIG. 16 along arrow X6.
Figure 18:
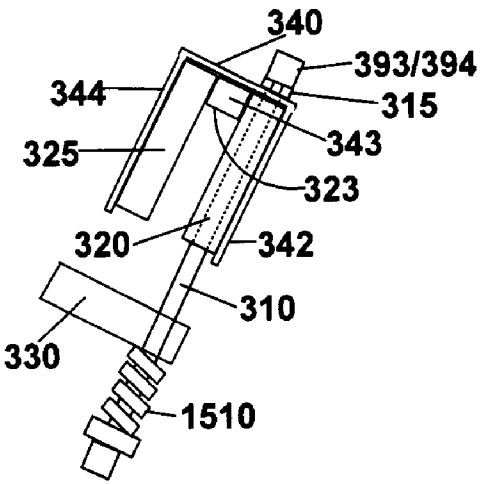
FIG. 18 is an enlarged view of the guide foot connected to the slidable attachment clamp of FIGS. 15–17.
Figure 19:
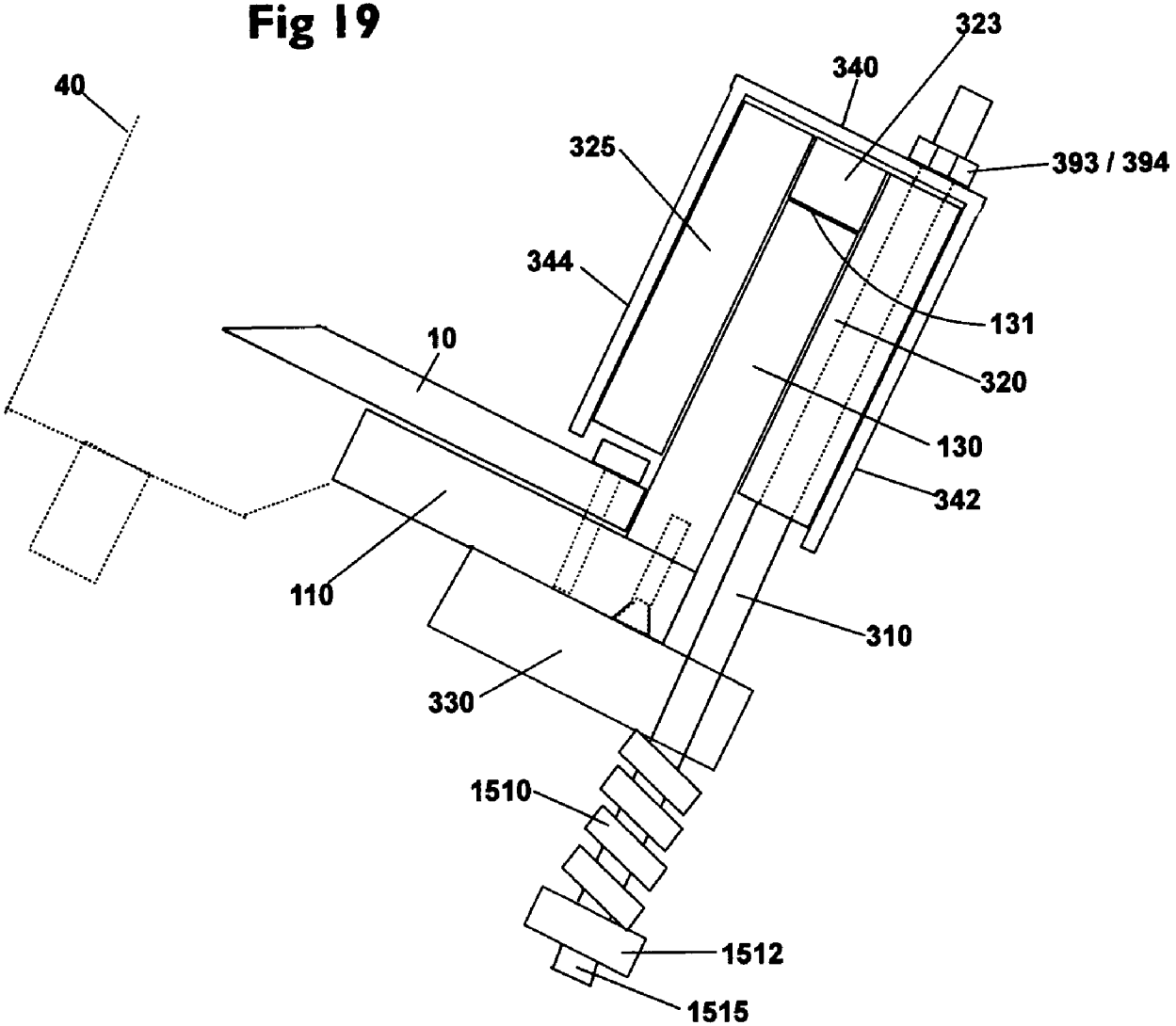
FIG. 19 is another view of the guide foot connected to the slidable attachment clamp about the trough of FIG. 18 with a blade mounted in the trough.

FIG. 17 is an end view of the guide foot 330 in the process of being attached along the direction of arrow F to guide member 320 of the carrier assembly 200/400 of FIG. 16 along arrow X6. FIG. 18 is side view of the guide foot 330 connected to the slidable attachment clamp components 340, 342, 344 of FIGS. 15–17. FIG. 19 is another view of the guide foot 330 connected to the slidable attachment clamp components 340, 342, 344 about the trough 40 of FIG. 18 with a blade 10 mounted in the trough 40.

Referring to FIGS. 17–19, guide foot 330 can be mounted to guide member 320 by having threaded rods 310, 310' that pass through longitudinal slots in guide member 320 and are held in place by upper nuts 315. The threaded rods 310, 310' pass through guide foot member 330, so that a compressible spring member 1510 is sandwiched between the guide foot member 330 and nuts 1515, 1535 with washers 1512, 1535 which are fastened about the lower ends of the threaded rods 310, 310'. A slidable clamp assembly can include a U-shaped bracket frame having a rear leg member 342 which can be fixably attached to rest against guide 320, while forward solid guide 325 is fixably attached to rest against an inner surface of forward leg portion 344 of the frame 340, with an upper solid guide 323 underneath the upper portion 343 of frame 340 between guides 320, 325. The inner facing surfaces of the guides 320, 323, 325 and upper exterior surface of guide foot 330 can include a slidable bearing surface such as but not limited to polished plastic, UHMW, and the like. The novel clamping components as depicted in FIG. 19, show that the guides 320, 323, 325 can slide about upper leg 130 about upper edge surface 131 and about sides of upper leg 130, while the guide foot 330 can slide under lower leg 110 of table 100. The entire assembly can be additionally stabilized by having springs 1510, 1530 which can constantly press guide foot 330 to abut against the lower leg 110 of table 100. The remaining components shown in FIGS. 17, 18, and 19 are similar to those described in the previous embodiment.

Figure 20B:
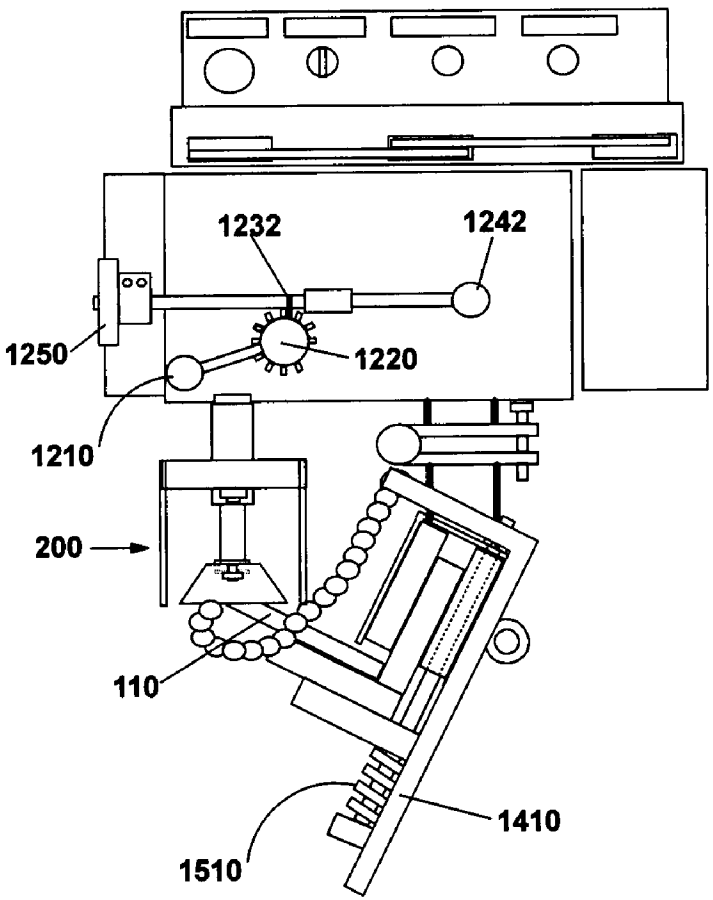
FIG. 20B shows the sharpening head of FIG. 20A moved downward in the direction of arrow D2 to a lowered position adjacent to the edge of the blade to be sharpened.
Figure 20A:
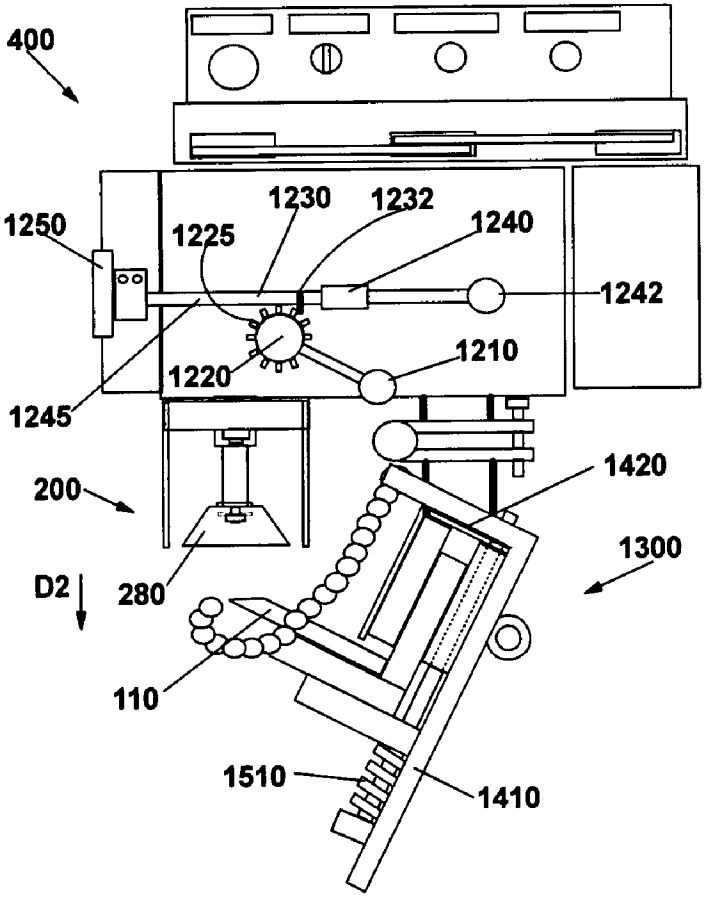
FIG. 20A shows an end view of FIG. 15 along arrow X6 of the carrier assembly about the table top and the control panel with the sharpening head in a raised position.

FIG. 20A shows an end view of FIG. 15 along arrow X6 of the carrier assembly about the table top and the control panel with the sharpening head 200 in a raised position. FIG. 20B shows the sharpening head 200 of FIG. 20A moved downward in the direction of arrow D2 to a lowered position adjacent to the edge of the blade 110 to be sharpened.

Referring to FIGS. 20A–20B, control handle 1210 can be rotated clockwise in the direction of arrow K1 which pivots sprocket 1220 having external teeth 1225 which can rub about bendable tab 1232 so that sharpening wheel 280 moves downward in the direction of arrow D2 to blade 110. A rotatable knob 1242 can move a locking sleeve on horizontal rod 1245 against moveable tab 1232 to lock the sprocket 1220 in a selected position. The other end of horizontal rod 1245 can threaded to pass through an internal threaded connector 1250.

Figure 21B:
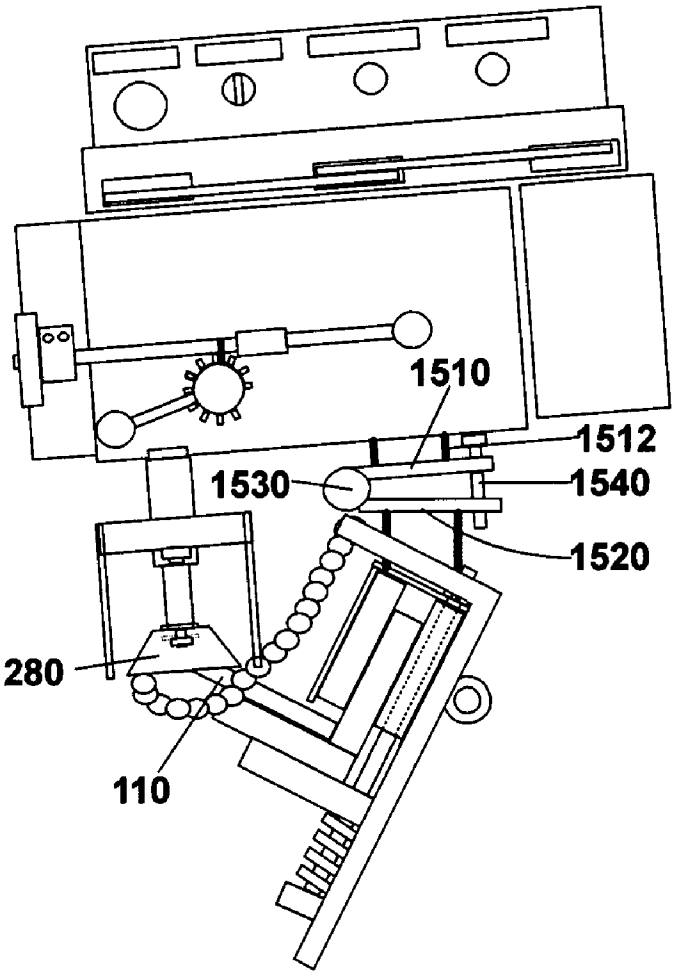
FIG. 21B shows FIG. 21 with the carrier angle adjusting hinge adjusted to a different angle for the sharpening wheel.
Figure 21A:
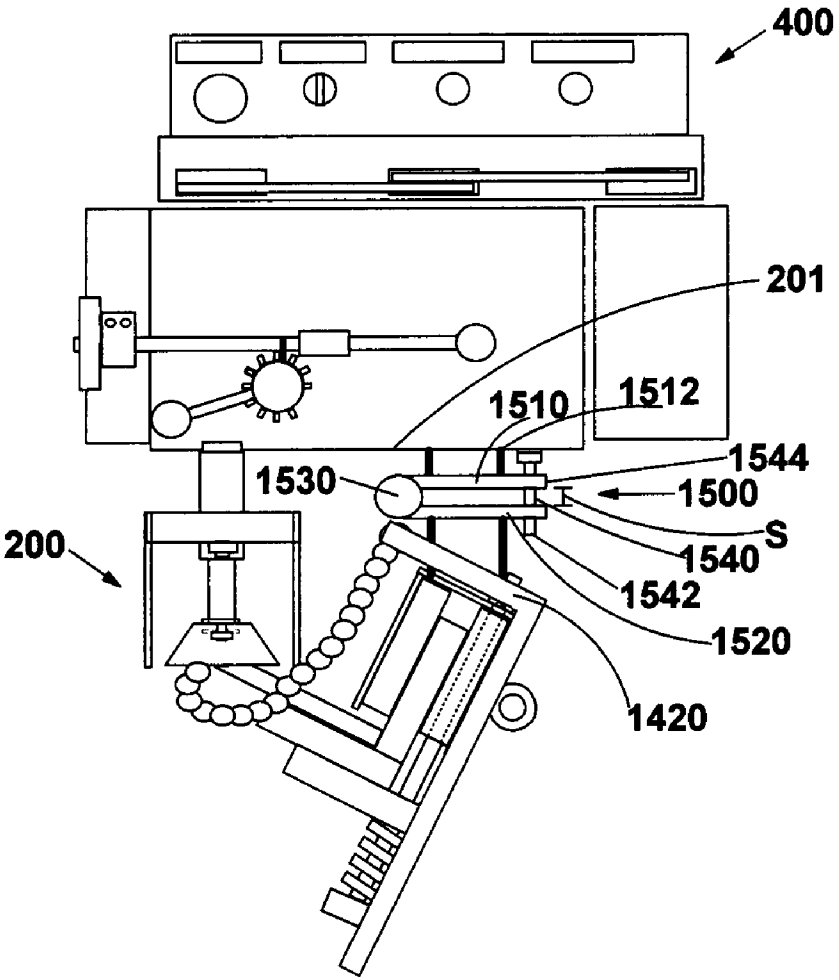
FIG. 21A shows the end view of FIG. 15 along arrow X6 with the carrier angle adjusting hinge in a first selected position.

FIG. 21A shows the end view of FIG. 15 along arrow X6 with the carrier angle adjusting hinge 1500 in a first selected position. FIG. 21B shows FIG. 21 with the carrier angle adjusting hinge 1500 adjusted to a different angle for the sharpening wheel 280. The adjustable hinge 1500 can include an upper member 1510 attached under housing 201 that is pivotally attached at one end 1530 to a lower member 1520 which is attached to upper leg 1420 of L bracket 1400. A threaded rod 1540 has a lower portion 1542 which threads into a threaded interior slot of lower member 1520, while the upper portion 1544 freely rotates within an upper unthreaded slot of upper member 1510. Causing the lower member 1520 to separate in the direction of arrow S allowing the sharpening wheel to move to a sharper angle against blade 110.

Figure 22:
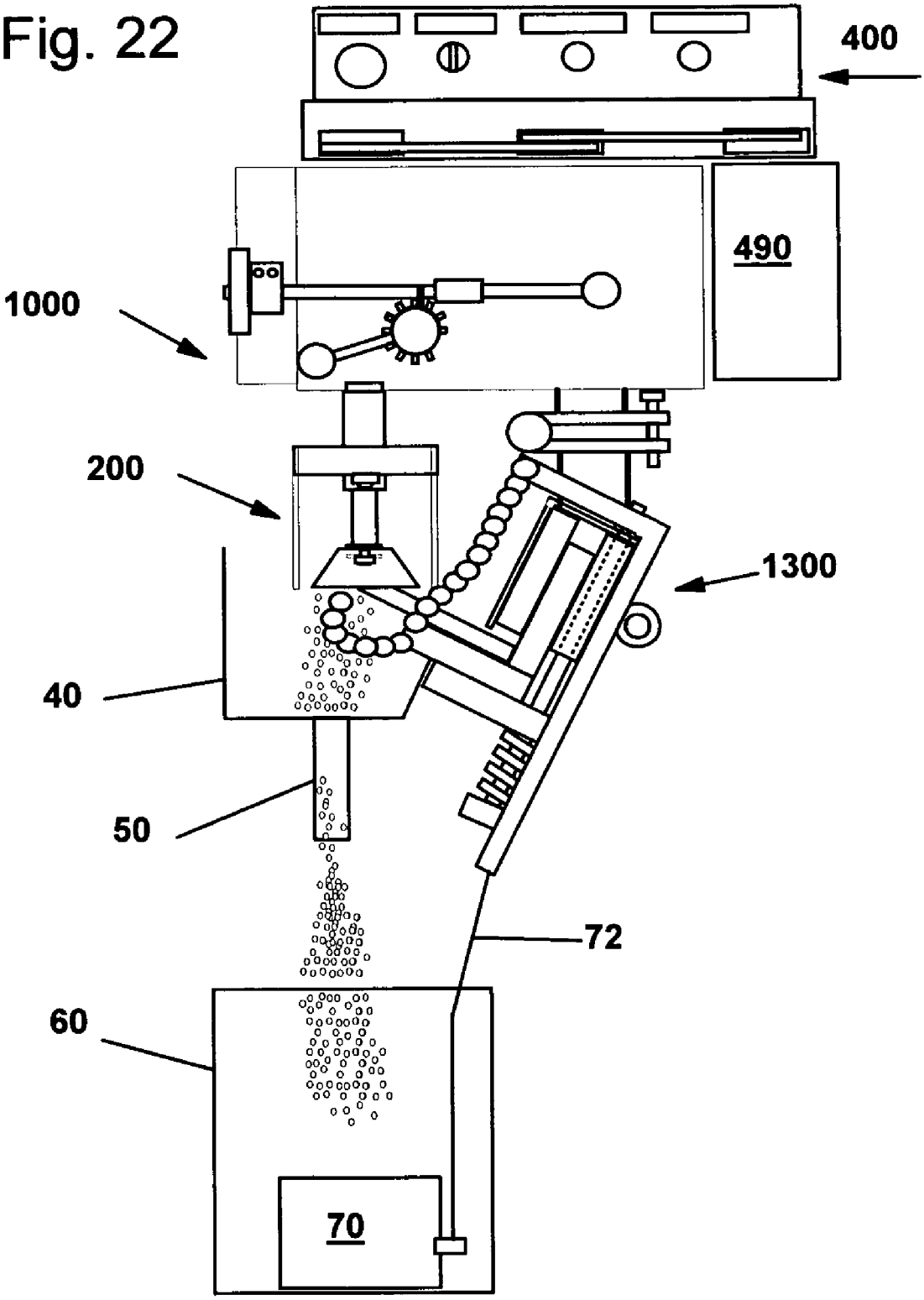
FIG. 22 shows an end view of table, control panel, sharpening head assembly, carrier assembly, recycling trough and recycling bucket of FIG. 15 along arrow X6 without the table support stands.

FIG. 22 shows an end view of table 110, control panel, sharpening head assembly 200, carrier assembly 400, recycling trough 60 and recycling bucket 70 of FIG. 15 along arrow X6 without the table support stands. FIG. 22 can function and operate similar to the arrangement shown and described in reference to FIG. 9.

Although the preferred embodiment of the invention has been described for sharpening edges on ice resurfacing machines, the invention can be used to sharpen edges on other longitudinal blades, such as but not limited to longitudinal blades on paper cutting machines, and the like, where businesses such as those used in the printing industry, such as but not limited to those used with a newspaper publisher, and the like.

The novel invention can also be used for sharpening other types of industrial blades but not limited to those blades used with cutting foil and fabric, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A blade resurfacing apparatus for resurfacing a large longitudinal blade from mobile ice resurfacing and paper cutting machines comprising:

a table surface for allowing the longitudinal blade to rest in a stationary position thereon, the blade having a length that fits within a length of the table surface;

means for positioning a sharpening wheel at a selected angle on the blade;

means for rolling the sharpening wheel along an upper surface edge of the stationary blade for sharpening the edge of the blade to a selected uniform sharpness; and a guide foot for sliding underneath the table surface while the sharpening wheel is rolling in order to stabilize sharpening of the edge of the blade.

2. The apparatus of claim 1, further comprising:

lever means for allowing a user to grip a handle to lower the sharpening wheel from a raised position to be abut against the edge of the blade in a lowered position.

3. The apparatus of claim 1, further comprising:

means for applying and recycling coolant to the blade while the sharpening wheel is rotating over the blade.

4. The apparatus of claim 1, wherein the positioning means includes:

a carrier supporting the sharpening wheel to the table surface so that only the sharpening wheel contacts the table surface; and means for adjusting the selected angle of the wheel to different angled degrees, the adjusting means being located on the carrier.

5. The apparatus of claim 4 wherein the adjusting means includes:

an upper member connected to the carrier; and a lower member; and a hinge connecting the upper member to the lower member; and means for separating the upper member and the lower member to the different angled degrees apart from one another.

6. The apparatus of claim 5, wherein the separating means includes:

a rotatable member being threadably connected to both the upper member and to the lower member, wherein rotating the rotatable member allows for selecting the different angled degrees.

7. The apparatus of claim 1, wherein the rolling means includes:

a carrier attached to the table for supporting the sharpening wheel on the blade so only the sharpening wheel contacts the blade;

a longitudinal rod adjacent to the table;

means for moving the carrier along the longitudinal rod, while the wheel is sharpening the edge of the blade.

8. The apparatus of claim 7, wherein the longitudinal rod includes:

first threads along the rod;

second threads on the carrier, which are mateably threaded to the first threads;

means for rotating the rod in place along the table so that the carrier moves in a horizontal direction along the rotating threaded rod.

9. The apparatus of claim 1, wherein the apparatus further includes:

an overall weight of less than approximately 250 pounds, and an overall length of less than approximately 120 inches.

10. The apparatus of claim 1, further comprising:

an electric motor for powering the rolling means.

11. A method for resharpening a longitudinal blade for mobile ice resurfacing and paper cutting machines, comprising the steps of:

supporting a longitudinal blade in a horizontal position on a table;

positioning a sharpening wheel to a selected angle on a side edge of the blade so that only the wheel contacts the blade;

automatically rolling the sharpening wheel up to no more than three passes over the longitudinal edge of the blade to form a uniform sharpness on the edge of the blade;

stabilizing the rolling sharpening wheel with a guide; and sliding the guide underneath the table.

12. The method of claim 11, further comprising the step of:

locating the table surface within a trough; and cooling the blade with a coolant; and recycling the coolant within the trough for reuse.

13. The method of claim 11, wherein the positioning step further includes:

rotating a handle-lever to lower the sharpening wheel from a raised position to a lowered position against the edge of the blade.

14. The method of claim 11, wherein the step of positioning includes the step of:

positioning the sharpening wheel to an angle between approximately 24 to approximately 26 degrees against the edge of the blade.

15. The method of claim 14, wherein the rolling and the positioning steps includes the step of:

supporting the sharpening wheel with a moving carrier to an edge of the table; and contacting the blade solely through the sharpening wheel of the carrier, as the sharpening wheel rolls along the edge of the blade, so that no other portions of the moving carrier.

16. The method of claim 15, further comprising the step of:

supporting the wheel by a carrier assembly to the edge of the table; and moving the carrier assembly along a guide rod that is adjacent to the table.

17. The method of claim 16, further comprising the step of:

rotating the guide rod in place adjacent to the table; and threading a portion of the carrier along a mateable threaded portion of the guide rod so that the carrier moves along the threads of the guide rod.

18. The method of claim 11, further comprising the step of:

supporting the wheel by a carrier assembly; and adjusting the positioning angle of the carrier assembly with an adjustable hinge.

19. The method of claim 18, wherein the adjusting step includes the step of:

separating parts of the hinge with a rotatable member being threadably connected to both an upper member and to a lower member of the hinge; and rotating the rotatable member to select different angled degrees of separation.

20. A blade resurfacing apparatus for resurfacing a large longitudinal blade from mobile ice resurfacing and paper cutting machines comprising:

a table surface for allowing the longitudinal blade to rest in a stationary position thereon, the blade having a length that fits within a length of the table surface;

means for positioning a sharpening wheel at a selected angle on the blade, the positioning means having a carrier supporting the sharpening wheel to the table surface so that only the sharpening wheel contacts the table surface and means for adjusting the selected angle of the wheel to different angled degrees, the adjusting means being located on the carrier, the adjusting means having an upper member connected to the carrier and a lower member and a hinge connecting the upper member to the lower member and means for separating the upper member and the lower member to the different angled degrees apart from one another, the separating means having a rotatable member being threadably connected to both the upper member and to the lower member, wherein rotating the rotatable member allows for selecting the different angled degrees; and means for rolling the sharpening wheel along an upper surface edge of the stationary blade for sharpening the edge of the blade to a selected uniform sharpness.

21. A blade resurfacing apparatus for resurfacing a large longitudinal blade from mobile ice resurfacing and paper cutting machines comprising:

a table surface for allowing the longitudinal blade to rest in a stationary position thereon, the blade having a length that fits within a length of the table surface;

means for positioning a sharpening wheel at a selected angle on the blade; and means for rolling the sharpening wheel along an upper surface edge of the stationary blade for sharpening the edge of the blade to a selected uniform sharpness, the rolling means having a carrier attached to the table for supporting the sharpening wheel on the blade so only the sharpening wheel contacts the blade and a longitudinal rod adjacent to the table and means for moving the carrier along the longitudinal rod, while the wheel is sharpening the edge of the blade, the longitudinal rod having first threads along the rod, second threads on the carrier, which are mateably threaded to the first threads, and means for rotating the rod in place along the table so that the carrier moves in a horizontal direction along the rotating threaded rod.

22. A method for resharpening a longitudinal blade for mobile ice resurfacing and paper cutting machines, comprising the steps of:

supporting a longitudinal blade in a horizontal position on a table;

positioning a sharpening wheel to a selected angle between approximately 24 to approximately 26 degrees on a side edge of the blade so that only the wheel contacts the blade;

automatically rolling the sharpening wheel up to no more than three passes over the longitudinal edge of the blade to form a uniform sharpness on the edge of the blade, the rolling and the positioning steps includes the step of:

supporting the sharpening wheel with a moving carrier to an edge of the table; and contacting the blade solely through the sharpening wheel of the carrier, as the sharpening wheel rolls along the edge of the blade, so that no other portions of the moving carrier; and supporting the wheel by a carrier assembly to the edge of the table;

moving the carrier assembly along a guide rod that is adjacent to the table;

rotating the guide rod in place adjacent to the table; and threading a portion of the carrier along a mateable threaded portion of the guide rod so that the carrier moves along the threads of the guide rod.

23. A method for resharpening a longitudinal blade for mobile ice resurfacing and paper cutting machines, comprising the steps of:

supporting a longitudinal blade in a horizontal position on a table;

positioning a sharpening wheel to a selected angle on a side edge of the blade so that only the wheel contacts the blade;

automatically rolling the sharpening wheel up to no more than three passes over the longitudinal edge of the blade to form a uniform sharpness on the edge of the blade;

supporting the wheel by a carrier assembly; and adjusting the positioning angle of the carrier assembly with an adjustable hinge, the adjusting step further includes the step of:

separating parts of the hinge with a rotatable member being threadably connected to both an upper member and to a lower member of the hinge; and rotating the rotatable member to select different angled degrees of separation.

* * * * *